US009211750B2

(12) United States Patent
Shinkawa

(10) Patent No.: US 9,211,750 B2
(45) Date of Patent: Dec. 15, 2015

(54) LIQUID EJECTION APPARATUS

(71) Applicant: SEIKO EPSON CORPORATION, Tokyo (JP)

(72) Inventor: Osamu Shinkawa, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 14/656,162

(22) Filed: Mar. 12, 2015

(65) Prior Publication Data

US 2015/0258829 A1 Sep. 17, 2015

(30) Foreign Application Priority Data

Mar. 14, 2014 (JP) ..... 2014-051212

(51) Int. Cl.
*B41J 2/045* (2006.01)
*B41J 29/393* (2006.01)

(52) U.S. Cl.
CPC ..... *B41J 29/393* (2013.01); *B41J 2/045* (2013.01)

(58) Field of Classification Search
CPC ..... B41J 2/04581; B41J 2/04588; B41J 2/04551; B41J 2/04578; B41J 2/04596; B41J 2/16526
See application file for complete search history.

(56) References Cited

U.S. PATENT DOCUMENTS 8,911,057 B2 * 12/2014 Yoshida ..... 347/19
2013/0293610 A1 * 11/2013 Suzuki et al. ..... 347/10

FOREIGN PATENT DOCUMENTS

JP 2013-028183 A 2/2013

* cited by examiner

*Primary Examiner* — Thinh Nguyen
(74) *Attorney, Agent, or Firm* — Maschoff Brennan

(57) ABSTRACT

A printing apparatus includes a cavity in which a pressure inside is increased or decreased due to displacement of a piezoelectric element; a nozzle that communicates the cavity and is capable of ejecting an ink filled in the inside; a driving signal generation unit that supplies a driving signal to the piezoelectric element; a detection unit that detects a change of an electromotive force of the piezoelectric element as a residual vibration signal; a comparison signal generation unit that generates a first comparison signal by binarizing the residual vibration signal with a first threshold potential and generates a second comparison signal by binarizing the residual vibration signal with a second threshold potential; and a determination data generation unit that determines an ejection state of a liquid in the nozzle based on at least the first comparison signal and the second comparison signal.

16 Claims, 21 Drawing Sheets

TEST VALUE AND CALCULATED VALUE OF RESIDUAL VIBRATION (WHEN EJECTION STATE IS NORMAL)

TEST VALUE AND CALCULATED VALUE
OF RESIDUAL VIBRATION (BUBBLES)

TEST VALUE AND CALCULATED VALUE OF RESIDUAL VIBRATION (DRYING)

TEST VALUE AND CALCULATED VALUE
OF RESIDUAL VIBRATION (PAPER DUST)

FIG. 16

| SI (b1, b2, b3) | Ts1 | | | Ts2 | | |
|---|---|---|---|---|---|---|
| | Sa | Sb | Sc | Sa | Sb | Sc |
| (1, 1, 0) | H | L | L | H | L | L |
| (1, 0, 0) | H | L | L | L | H | L |
| (0, 1, 0) | L | H | L | H | L | L |
| (0, 0, 0) | L | H | L | L | H | L |
| (0, 0, 1) | L | L | H | L | L | H |

FIG. 26

| DF | CONTENTS |
|---|---|
| 00 | frg1 = 1 |
| 01 | NtF < Fmin |
| 10 | Fmax < NtF |
| 11 | Fmin ≤ NtF ≤ Fmax |

FIG. 27

| DC | CONTENTS |
|---|---|
| 00 | frg2 = 1 |
| 01 | NtC < Cmin |
| 10 | Cmax < NtC |
| 11 | Cmin ≤ NtC ≤ Cmax |

FIG. 28

| NO | PARAMETER | | | Rs | CONTENTS |
|---|---|---|---|---|---|
| | DL (NtDadd) | DF (NtF) | DC (NtC) | | |
| 1 | 1 | 00 | 00 | 00 | ERROR |
| 2 | 1 | 00 | 01 | 00 | ERROR |
| 3 | 1 | 00 | 10 | 00 | ERROR |
| 4 | 1 | 00 | 11 | 00 | ERROR |
| 5 | 1 | 01 | 00 | 01 | BUBBLES |
| 6 | 1 | 01 | 01 | 01 | BUBBLES |
| 7 | 1 | 01 | 10 | 01 | BUBBLES |
| 8 | 1 | 01 | 11 | 01 | BUBBLES |
| 9 | 1 | 10 | 00 | 00 | THICKENING |
| 10 | 1 | 10 | 01 | 01 | BUBBLES |
| 11 | 1 | 10 | 10 | 10 | OOZING |
| 12 | 1 | 10 | 11 | 10 | OOZING |
| 13 | 1 | 11 | 00 | 00 | THICKENING |
| 14 | 1 | 11 | 01 | 01 | BUBBLES |
| 15 | 1 | 11 | 10 | 00 | THICKENING |
| 16 | 1 | 11 | 11 | 11 | NORMAL |
| 17 | 0 | 00 | 00 | 00 | THICKENING |
| 18 | 0 | 00 | 01 | 00 | ERROR |
| 19 | 0 | 00 | 10 | 00 | ERROR |
| 20 | 0 | 00 | 11 | 00 | ERROR |
| 21 | 0 | 01 | 00 | 01 | BUBBLES |
| 22 | 0 | 01 | 01 | 01 | BUBBLES |
| 23 | 0 | 01 | 10 | 01 | BUBBLES |
| 24 | 0 | 01 | 11 | 01 | BUBBLES |
| 25 | 0 | 10 | 00 | 00 | THICKENING |
| 26 | 0 | 10 | 01 | 00 | THICKENING |
| 27 | 0 | 10 | 10 | 00 | THICKENING |
| 28 | 0 | 10 | 11 | 00 | THICKENING |
| 29 | 0 | 11 | 00 | 01 | BUBBLES |
| 30 | 0 | 11 | 01 | 01 | BUBBLES |
| 31 | 0 | 11 | 10 | 01 | BUBBLES |
| 32 | 0 | 11 | 11 | 00 | THICKENING |

LIQUID EJECTION APPARATUS

BACKGROUND

1. Technical Field

The present invention relates to a liquid ejection apparatus.

2. Related Art

An ink jet printer allows an ink filled in an ejection unit to be ejected and forms an image on a recording medium by allowing a piezoelectric element provided in the ejection unit to be driven by a driving signal.

However, when the ink in the ejection unit is thickened, ejection abnormality occurs and the image quality of the image to be printed is degraded in some cases. Further, in a case where the ink in the ejection unit includes bubbles or paper dust is adhered to the vicinity of a nozzle of the ejection unit, ejection abnormality occurs and the image quality of the image to be printed is degraded in some cases. Accordingly, it is preferable to inspect an ejection state of the ink in the ejection unit for realizing high grade printing.

JP-A-2013-028183 discloses a technique of detecting residual vibration generated by allowing the piezoelectric element to be driven by the driving signal and inspecting the ejection state of the ink in the ejection unit based on detection results.

The inspection of the ejection state of the ink in the ejection unit is performed using a residual vibration waveform when the piezoelectric element is driven. It is possible to specify the cycle of the residual vibration by measuring the cycle of a comparison signal obtained by comparing the residual vibration waveform with a predetermined threshold potential.

However, in regard to information of the residual vibration waveform in an amplitude direction, it is necessary to perform AD conversion on the residual vibration waveform, but there is a problem in that the configuration of an AD converter is complicated.

SUMMARY

An advantage of some aspects of the invention is to obtain information of residual vibration in an amplitude direction with a simple configuration.

According to an aspect of the invention, there is provided a liquid ejection apparatus including: a piezoelectric element that is displaced according to a driving signal; a pressure chamber whose inside is filled with a liquid and in which a pressure inside is increased or decreased by the displacement of the piezoelectric element based on the driving signal; a nozzle that communicates with the pressure chamber and is capable of ejecting the liquid filled in the inside of the pressure chamber through the increase or decrease of the pressure in the inside of the pressure chamber; a driving signal supply unit that supplies the driving signal to the piezoelectric element; a detection unit that detects a change of an electromotive force of the piezoelectric element as a residual vibration signal based on the change of the pressure in the inside of the pressure chamber, which is generated after the driving signal is supplied to the piezoelectric element; a comparison signal generation unit that generates a first comparison signal obtained by binarizing the residual vibration signal with a first threshold value and a second comparison signal obtained by binarizing the residual vibration signal with a second threshold value; and a determination unit that determines an ejection state of the liquid in the nozzle based on at least the first comparison signal and the second comparison signal.

According to the aspect of the above-described liquid ejection apparatus, the first comparison signal and the second comparison signal are generated by respectively binarizing the residual vibration signal by the first threshold value and the second threshold value. In this manner, by binarizing the residual vibration signal with two different threshold values, it becomes possible to more accurately determine the ejection state when compared with the case in which the ejection state of the liquid in the nozzle is determined based on only the first comparison signal or only the second comparison signal.

In the aspect of the above-described liquid ejection apparatus, it is preferable that the first threshold value substantially coincide with an amplitude center level of the residual vibration signal and the determination unit include a phase index data generation unit generating phase index data according to a phase of the residual vibration signal based on the first comparison signal and an amplitude index data generation unit generating amplitude index data according to the amplitude of the residual vibration signal based on at least the second comparison signal and determine an ejection state of a liquid in the nozzle based on the phase index data and the amplitude index data.

Since the residual vibration signal is damped with time, the phase thereof can be known by the timing at which the level of the residual vibration signal substantially coincides with the amplitude center level. In addition, it is possible to obtain an amplitude index in accordance with the amplitude of the residual vibration signal by comparing the second threshold value with the residual vibration signal. Generally, in order to obtain information related to the amplitude of a signal, AD conversion of the signal is required, but, according to the aspect of the invention, information related to the amplitude can be obtained using a simple configuration. As a result, it is possible to accurately determine the ejection state of the liquid in the nozzle. Further, the amplitude center level of the residual vibration signal means a level of the residual vibration signal in a state in which the residual vibration is substantially damped and converged and an external force is not applied to the piezoelectric element which is a generation source of the amplitude. Further, the expression "substantially coincides with" means that the first threshold value may not completely coincide with the amplitude center level and the phase or the cycle of the residual amplitude may include an error to an extent that the ejection state of the nozzle can be determined.

In the aspect of the above-described liquid ejection apparatus, it is preferable that the comparison signal generation unit generate a third comparison signal obtained by binarizing the residual vibration signal by a third threshold value and the amplitude index data generation unit specify a first time showing a time for which the residual vibration signal exceeds the second threshold value based on the second comparison signal and a second time showing a time for which the residual vibration detection signal exceeds the third threshold value based on the third comparison signal and generate the amplitude index data by summing up at least the first time and the second time.

According to the aspect of the invention, since the residual vibration signal is compared with a plurality of threshold values and the amplitude index data is generated by summing up the times obtained from the comparison results, the precision of the amplitude index data can be improved.

In the aspect of the above-described liquid ejection apparatus, it is preferable that the determination unit include a cycle index data generation unit generating cycle index data according to a cycle of the residual vibration signal based on the first comparison signal and determine an ejection state of a liquid in the nozzle based on the phase index data, the cycle index data, and the amplitude index data. According to the aspect of the invention, since the ejection state of the liquid in the nozzle is determined in consideration of the phase index data, it is possible to determine the ejection state more accurately.

In the aspect of the above-described liquid ejection apparatus, it is preferable that the phase index data generation unit generate a time, as the phase index data, from application of the driving signal to the piezoelectric element to an edge of the first comparison signal generated after the first comparison signal is invalidated for a predetermined amount of time, and the cycle index data generation unit generate a time of one cycle, as the cycle index data, after the edge of the first comparison signal is generated. According to the aspect of the invention, the cycle index data is generated after the phase index data is generated. In order to detect the cycle, the residual amplitude signal needs to be stabilized without being affected by noise for at least one cycle of time. Meanwhile, it is not necessary for the phase of the residual amplitude signal to be stabilized for a period of one cycle. The noise accompanied by switching of the piezoelectric element is superimposed on the residual amplitude signal, but two pieces of index data can be stabilized in a short time and generated because the phase index data is generated first and then the cycle index data is generated.

In the aspect of the above-described liquid ejection apparatus, it is preferable that the determination unit determine that bubbles are mixed into the pressure chamber in a case where the amplitude index data is in a normal range and the phase index data is lower than the lower limit of the normal range. In this case, it is considered that the phase of the residual vibration signal advances because of a decrease in inertance due to the bubbles.

In the aspect of the above-described liquid ejection apparatus, it is preferable that the determination unit determine that the liquid is thickened in a case where the amplitude index data is in the normal range, the phase index data exceeds the upper limit of the normal range, and generation of the cycle index data based on the residual amplitude signal is not possible. Since the phase index data exceeds the upper limit, the inertance is increased. Accordingly, it is possible to determine that the liquid is thickened.

In the aspect of the above-described liquid ejection apparatus, it is preferable that the determination unit determine that bubbles are mixed into the pressure chamber in a case where the amplitude index data is in the normal range, the phase index data exceeds the upper limit of the normal range, and the cycle index data is lower than the lower limit of the normal range. Since the cycle index data is lower than the lower limit of the normal range, it is possible to consider that the inertance is decreased due to the bubbles.

In the aspect of the above-described liquid ejection apparatus, it is preferable that the determination unit determine that the liquid oozes out from the nozzle in a case where the amplitude index data is in the normal range, the phase index data exceeds the upper limit of the normal range, and the cycle index data is greater than or equal to the lower limit of the normal range. It is considered that the ink oozes out and the inertance is increased because the amplitude of the residual amplitude signal is in the normal range and the phase exceeds the upper limit of the normal range.

In the aspect of the above-described liquid ejection apparatus, it is preferable that the determination unit determine that the liquid is thickened in a case where generation of the cycle index data based on the residual vibration signal is not possible or the cycle index data exceeds the upper limit of the normal range when the amplitude index data is in the normal range and the phase index data is in the normal range. It is considered that the amplitude is decreased due to the thickening of the liquid in the case where the generation of the cycle index data is not possible or the inertance is increased due to the thickening of the liquid in the case where the cycle index data exceeds the upper limit.

In the aspect of the above-described liquid ejection apparatus, it is preferable that the determination unit determine that bubbles are mixed into the pressure chamber in a case where the amplitude index data is in the normal range, the phase index data is in the normal range, and the cycle index data is lower than the lower limit of the normal range. It is considered that the inertance is decreased due to the bubbles because the cycle index becomes shorter.

In the aspect of the above-described liquid ejection apparatus, it is preferable that the determination unit determine that bubbles are mixed into the pressure chamber in a case where the amplitude index data is lower than the lower limit of the normal range and the phase index data is lower than the lower limit of the normal range. It is considered that the inertance is decreased due to the bubbles because the phase advances.

In the aspect of the above-described liquid ejection apparatus, it is preferable that the determination unit determine that the liquid is thickened in a case where the amplitude index data is lower than the lower limit of the normal range and the phase index data exceeds the upper limit of the normal range. It is considered that the inertance is increased due to the thickening of the liquid because the phase index is delayed.

In the aspect of the above-described liquid ejection apparatus, it is preferable that the determination unit determine that bubbles are mixed into the pressure chamber in a case where generation of the cycle index data based on the residual vibration signal is not possible, the cycle index data is lower than the lower limit of the normal range, or the cycle index data exceeds the upper limit of the normal range when the amplitude index data is lower than the lower limit of the normal range and the phase index data is in the normal range.

In the aspect of the above-described liquid ejection apparatus, it is preferable that the determination unit determine that the liquid is thickened in a case where the amplitude index data is lower than the lower limit of the normal range, the phase index data is in the normal range, and the cycle index data is in the normal range.

In the aspect of the above-described liquid ejection apparatus, it is preferable that the first threshold value substantially coincide with the amplitude center level of the residual vibration signal and the determination unit include a cycle index data generation unit generating cycle index data according to a cycle of the residual vibration signal based on the first comparison signal and an amplitude index data generation unit generating amplitude index data according to the amplitude of the residual vibration signal based on at least the second comparison signal and determine an ejection state of a liquid in the nozzle based on a ratio of the amplitude index data to the cycle index data. The cycle index data varies for each nozzle, but, according to the aspect of the invention, it is possible to evaluate the amplitude by absorbing the variation of the cycle because the amplitude of the residual vibration can be normalized by the cycle. As a result, it is possible to determine the ejection state of a liquid in a nozzle more accurately.

The above-described liquid ejection apparatus according to the aspect may include a predetermined number of the nozzles, and, the determination unit may determine whether index data generated based on at least the first comparison signal and the second comparison signal exceeds a threshold value, determine that a liquid oozes out from the predetermined number of nozzles in a case where the number of the nozzles determined in which the index data exceeds the threshold value is greater than or equal to a reference value, and determine that a liquid has not oozed out from the predetermined number of nozzles in a case where the number of nozzles determined in which the index data exceeds the threshold value is lower than the reference value.

There is a part in which distribution with respect to the index of the number of nozzles of a normal ejection state is overlapped with distribution with respect to the number of nozzles from which a liquid oozes out. Accordingly, when the threshold value is set to the overlapped part, a nozzle to be determined as oozing out is generated although the liquid is normally ejected. Further, there is a tendency that oozing out of the liquid is generated in a plurality of nozzles. According to the aspect of the invention, in a case where the number of nozzles exceeding the threshold value is lower than the reference value when it is determined whether the index with respect to a predetermined number of nozzles exceeds the threshold value, since it is determined that oozing out is not generated with respect to the predetermined nozzles, the probability of over-detection of oozing out of the liquid can be reduced.

BRIEF DESCRIPTION OF THE DRAWINGS

The invention will be described with reference to the accompanying drawings, wherein like numbers reference like elements.

FIG. 16 is an explanatory diagram illustrating the contents of decoding of a decoder.

FIG. 26 illustrates a truth table of phase evaluation data.

FIG. 27 illustrates a truth table of cycle evaluation data.

FIG. 28 illustrates a truth table of determination data.

DESCRIPTION OF EXEMPLARY EMBODIMENTS

Hereinafter, embodiments for implementing the invention will be described with reference to the drawings. However, throughout the drawings, dimensions and scaling of the respective parts are appropriately different from those of actual parts. Moreover, since embodiments described herein are preferred concrete examples of the invention, the embodiments are provided with various limitations that are technologically preferred, but the scope of the invention is not limited to the embodiments unless there is particularly a disclosure which limits the invention in the following description.

Embodiment

In the present embodiment, it will be described that an ink jet printer that ejects ink (one example of a "liquid") to form an image on recording paper P is exemplified as a printer.

1. Configuration of Ink Jet Printer

Figure 1:
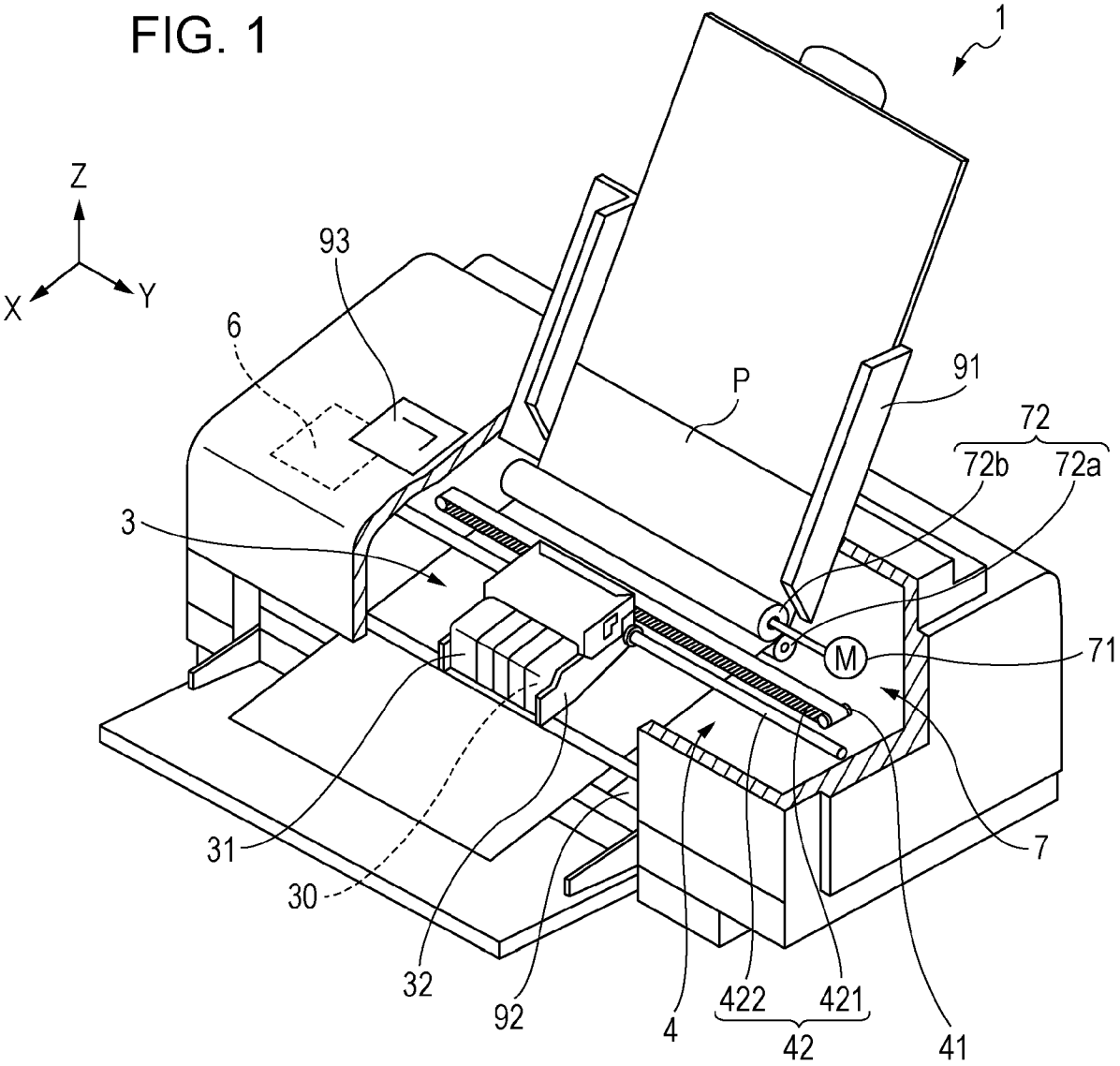
FIG. 1 is a schematic view illustrating an outline of a configuration of an ink jet printer according to a first embodiment of the invention.

FIG. 1 is a schematic perspective view illustrating a configuration of an ink jet printer 1 according to the present embodiment. The configuration of the ink jet printer 1 will be described with reference to FIG. 1. Further, in the following description, in FIG. 1, an upper side (+Z direction) is also referred to an "upper part", a lower side (−Z direction) is also referred to as a "lower part."

As illustrated in FIG. 1, the ink jet printer 1 includes a tray 91 that positions the recording paper P on an upper rear side, a paper delivery port 92 that delivers the recording paper P on a front lower side, and an operation panel 93 on an upper surface.

The operation panel 93 includes a liquid-crystal display, an organic EL display, or an LED lamp, and includes a display unit (not illustrated) that displays an error message, and an operation unit (not illustrated) that includes various switches. The display unit of the operation panel 93 functions as a notification unit.

Moreover, as illustrated in FIG. 1, the ink jet printer 1 includes a printing unit 4 having a moving body 3 that reciprocates.

The moving body 3 includes a head unit 30 that includes M number of ejection units 35, four ink cartridges 31, and a carriage 32 on which the head unit 30 and the four ink cartridges 31 are mounted (M is a natural number of two or more). The respective ejection units 35 may have the insides thereof filled with inks supplied from the ink cartridges 31, and eject the filled inks. Moreover, the four ink cartridges 31 are provided in a one-to-one correspondence with four colors of yellow, cyan, magenta and black, and the respective ink cartridges 31 are filled with inks of colors corresponding to the ink cartridges 31. Each of the M number of ejection units 35 receives the ink from any one of the four ink cartridges 31. Accordingly, the four colors of inks can be ejected from the M number of ejection units 35 as a whole, so that full color printing is realized.

Further, the ink jet printer 1 according to the present embodiment includes the four ink cartridges 31 corresponding to the four colors of inks, but the invention is not limited thereto. Ink cartridges 31 filled with inks of colors different from the four colors may be further included, or only ink cartridges 31 corresponding to some colors of the four colors may be included.

Moreover, the ink cartridges 31 may be provided at another location on the ink jet printer 1 other than the carriage 32.

As illustrated in FIG. 1, the printing unit 4 includes a carriage motor 41 serving as a driving source that allows the moving body 3 to move (reciprocate) in a main scanning direction, and a reciprocating mechanism 42 that receives a rotation of the carriage motor 41 to allow the moving body 3 to reciprocate. Further, the main scanning direction is a direction in which a Y axis extends in FIG. 1. The reciprocating mechanism 42 has a carriage guide shaft 422 whose both ends are supported by a frame (not illustrated), and a timing belt 421 that extends in parallel with the carriage guide shaft 422. The carriage 32 of the moving body 3 is supported by the carriage guide shaft 422 of the reciprocating mechanism 42 to be able to reciprocate, and is fixed to a part of the timing belt 421. For this reason, when the timing belt 421 is moved in a forward or reverse direction through a pulley by an operation of the carriage motor 41, the moving body 3 is guided by the carriage guide shaft 422 to reciprocate.

Moreover, as illustrated in FIG. 1, the ink jet printer 1 includes a paper feed device 7 that supplies or discharges the recording paper P to or from the printing unit 4.

The paper feed device 7 includes a paper feed motor 71 serving as a driving source thereof, and paper feed rollers 72 rotated by an operation of the paper feed motor 71. The paper feed rollers 72 include a driven roller 72*a* and a driving roller 72*b* that face in upper and lower sides with a transportation route (the recording paper P) of the recording paper P interposed therebetween, and the driving roller 72*b* is connected to the paper feed motor 71. Thus, the paper feed rollers 72 send a plurality of sheets of recording paper P positioned in the tray 91 toward the printing unit 4 one by one, or discharge the plurality of sheets of recording paper from the printing unit 4 one by one. Further, a paper feed cassette that accommodates the recording paper P may be detachably attached instead of the tray 91.

Moreover, as illustrated in FIG. 1, the ink jet printer 1 includes a control unit 6 that controls the printing unit 4 and the paper feed device 7.

The control unit 6 performs a printing process on the recording paper P by controlling the printing unit 4 and the paper feed device 7 based on image data Img input from a host computer 9 such as a personal computer or a digital camera.

Specifically, the control unit 6 intermittently sends the recording paper P in a sub scanning direction (an X-axis direction) one by one by controlling the paper feed device 7. Moreover, the control unit 6 controls the moving body 3 to reciprocate in the main scanning direction (a Y-axis direction) crossing with the sending direction (the X-axis direction) of the recording paper P. That is, the control unit 6 performs the printing process on the recording paper P by ejecting the inks from the respective ejection units 35 based on the image data Img or controlling the driving of the head unit 30 to discharge the inks while controlling the moving body 3 to reciprocate in the main scanning direction and controlling the paper feed device 7 to intermittently send the recording paper P in the sub scanning direction.

Further, the control unit 6 displays an error message on the display unit of the operation panel 93, or turns on and off the LED lamp or the like. The control unit allows the respective parts to perform the corresponding processes based on depression signals of various switches input from the operation unit of the operation panel 93. Furthermore, the control unit 6 may perform a process of transferring information of ejection abnormality or an error message to the host computer 9 if necessary.

Figure 2:
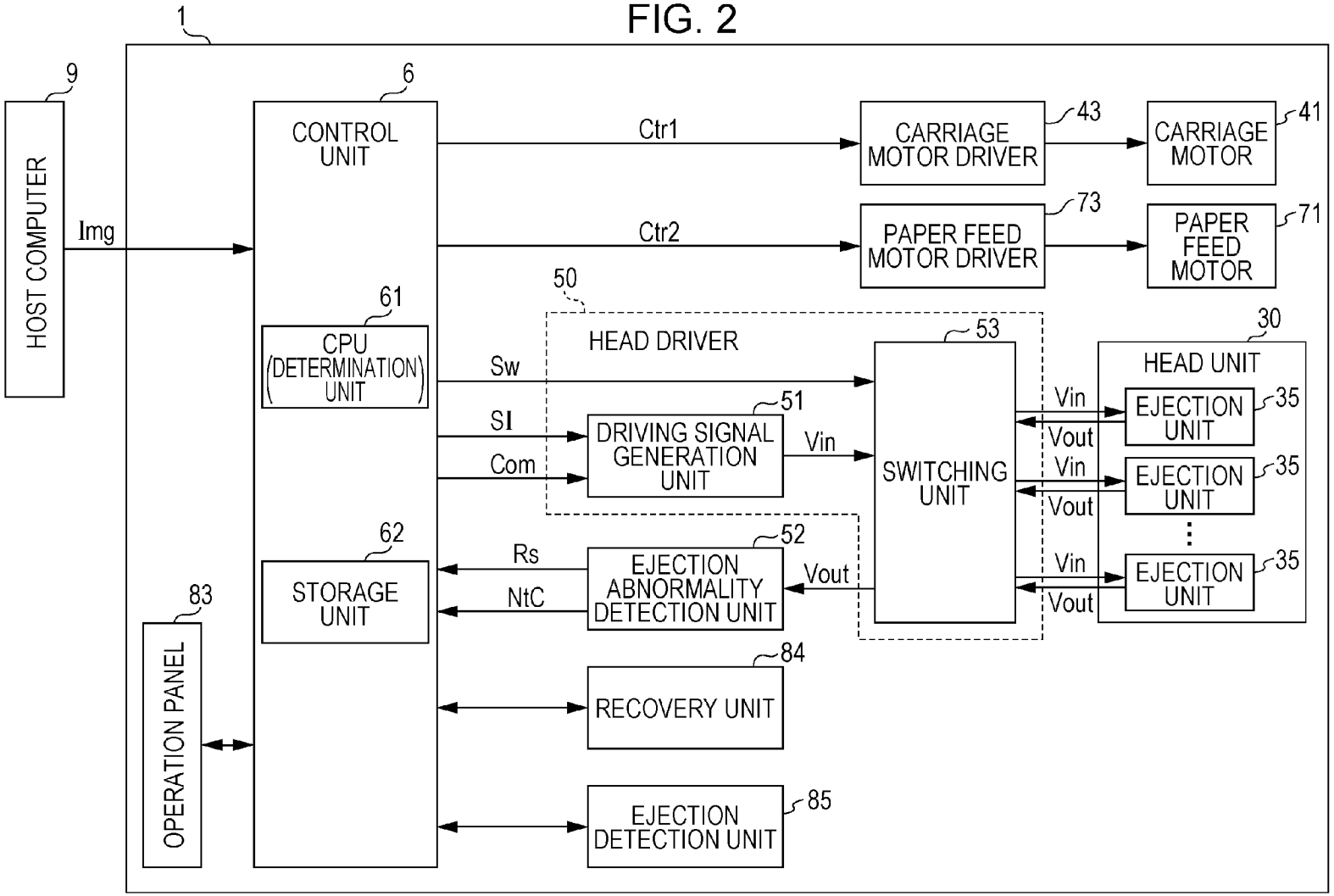
FIG. 2 is a block diagram illustrating the configuration of the ink jet printer.

FIG. 2 is a functional block diagram illustrating the configuration of the ink jet printer 1 according to the present embodiment.

The ink jet printer 1 includes the head unit 30 including the M number of ejection units 35, a head driver (one example of a "driving signal supplying unit") that drives the head unit 30, an ejection abnormality detection unit 52 that detects ejection abnormality of the ejection unit 35, and a recovery mechanism 84 that recovers the ejection unit 35 from the ejection abnormality to normality when the ejection abnormality of the ejection unit 35 is detected.

Moreover, the ink jet printer 1 includes the carriage motor 41 for allowing the head unit 30 to reciprocate, a carriage motor driver 43 that drives the carriage motor 41, the paper feed motor 71 for transporting the recording paper P, and a paper feed motor driver 73 that drives the paper feed motor 71.

Moreover, the ink jet printer 1 includes the control unit 6 for controlling the operations of the respective parts of the ink jet printer 1.

As illustrated in FIG. 2, the control unit 6 includes a CPU 61, and a storage unit 62.

The storage unit 62 includes an EEPROM (Electrically Erasable Programmable Read-Only Memory) which is a kind of a non-volatile semiconductor memory that stores the image data Img supplied through a non-illustrated interface unit from the host computer 9 in a data storage area. Moreover, the storage unit 62 includes a RAM (Random Access Memory) that temporarily stores data required to perform various processes such as a printing process and the like and temporarily develops a control program for executing various processes such as a printing process and the like. Moreover, the storage unit 62 includes a PROM which is a kind of a non-volatile semiconductor memory that stores the control program for controlling the respective parts of the ink jet printer 1.

The CPU 61 stores the image date Img supplied from the host computer 9 in the storage unit 62. Moreover, based on various data such as the image data Img stored in the storage unit 62, the CPU 61 generates a driver control signal Ctr1 for controlling the operation of the carriage motor driver 43, a driver control signal Ctr2 for controlling the operation of the paper feed motor driver 73, a printing signal SI for controlling the operation of the head driver 50 to drive the ejection units 35, various signals such as a switching control signal Sw and a driving waveform signal Com, a signal for controlling the operation of the recovery mechanism 84, and a signal for controlling the operation of the operation panel 93, and outputs the generated signals.

The head driver 50 includes a driving signal generation unit 51, an ejection abnormality detection unit 52, and a switching unit 53.

The driving signal generation unit 51 generates a driving signal Vin for driving the ejection units 35 included in the head unit 30 based on the printing signal SI and the driving waveform signal Com supplied from the control unit 6. Further, although details will be described below, the driving waveform signal Com in the present embodiment includes driving waveform signals Com-A, Com-B and Com-C.

The ejection abnormality detection unit 52 detects, as a residual vibration signal Vout, a change of an internal pressure of the ejection unit 35 caused by vibration of the ink within the ejection unit 35 which is generated after the ejection unit 35 is driven by the driving signal Vin. Moreover, the ejection abnormality detection unit 52 determines an ejection state of the ink in the ejection unit 35 such as whether or not the ejection abnormality occurs in the ejection unit 35 based on the residual vibration signal Vout, and outputs determination data Rs representing the determination result. Moreover, the ejection abnormality detection unit 52 outputs cycle index data NtC representing a cycle corresponding to one wavelength of a waveform represented by the residual vibration signal Vout.

The switching unit 53 electrically connects the respective ejection units 35 to any one of the driving signal generation unit 51 and the ejection abnormality detection unit 52, based on the switching control signal Sw supplied from the control unit 6.

Moreover, the ink jet printer 1 includes an ejection detection unit 85 that detects whether or not the ejection unit 35 ejects the ink.

The ejection detection unit 85 detects whether the ejection unit 35 ejects the ink by using, for example, an optical unit, and outputs the detection result.

As stated above, the control unit 6 (the CPU 61) controls the respective parts of the ink jet printer 1 such as the carriage motor driver 43, the paper feed motor driver 73, the head driver 50, the operation panel 93 and the recovery mechanism 84 by generating various signals such as the driver control signal Ctr1, the driver control signal Ctr2, the printing signal SI, the driving waveform signal Com and the switching control signal Sw to supply the generated signals to the respective parts of the ink jet printer 1.

Thus, the control unit 6 (the CPU 61) executes various processes such as the printing process, the ejection abnormality detecting process, the inspection waveform determining process and the recovery process.

Here, the printing process is a process of ejecting the ink from the ejection unit 35 to form an image on the recording paper P by controlling the operation of the head driver 50 by the control unit 6 based on the image data Img.

Moreover, the ejection abnormality detecting process is a process of generating residual vibration in the ejection unit 35 to inspect the ejection state of the ink in the ejection unit 35 based on the generated residual vibration by controlling the operation of the head driver 50 to supply the driving signal Vin for inspection to the ejection unit 35 by the control unit 6.

Moreover, the inspection waveform determining process is a process of determining a waveform of the driving signal Vin for inspection supplied from the head driver 50 to the ejection unit 35 serving as a target of the ejection abnormality detecting process.

Moreover, the recovery process is referred to as a process for recovering the ejection state of the ink of the ejection unit 35 to the normality such as a wiping process of wiping a foreign substance such as paper powder attached to a nozzle plate 240 of the ejection unit 35 by a wiper (not illustrated) when the ejection abnormality of the ink is detected in the ejection unit 35 in the ejection abnormality detecting process using the recovery mechanism 84, a pumping process of sucking ink or bubbles thickened within a cavity 245 of the ejection unit 35 by a tube pump (not illustrated), or a flushing process of preliminarily ejecting the ink from the ejection unit 35. The control unit 6 selects one or two or more recovery processes appropriate to recover the ejection state of the ejection unit 35 from among the flushing process, the wiping process and the pumping process, and executes the selected recovery process.

2. Configuration of Head Unit

Next, configurations of the head unit 30 and the ejection unit 35 including the head unit 30 will be described with reference to FIGS. 3 and 4.

Figure 3:
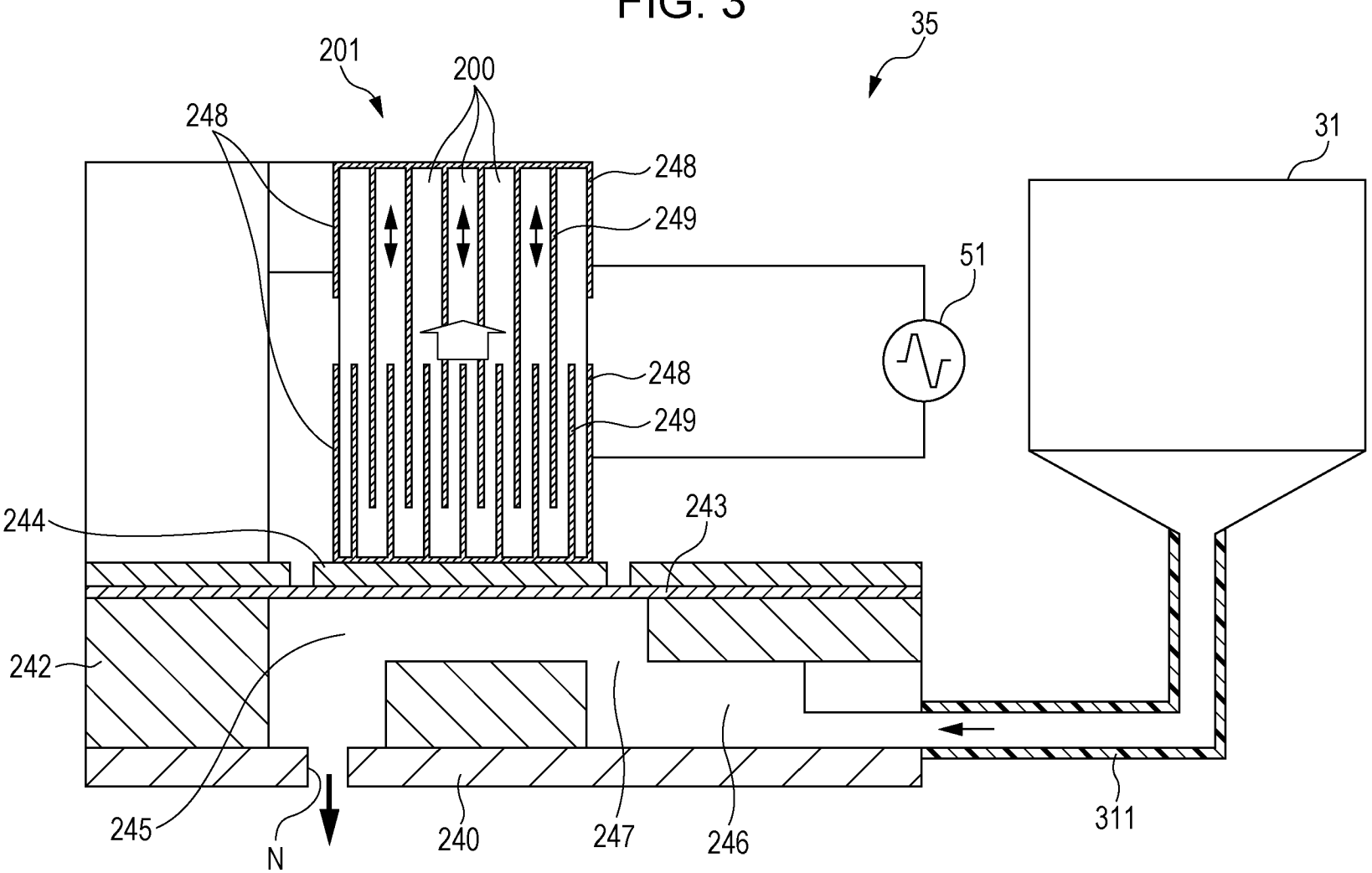
FIG. 3 is a cross-sectional view schematically illustrating an ejection unit.

FIG. 3 is a schematic cross-sectional view of the ejection unit 35 included in the head unit 30. The ejection unit 35 illustrated in FIG. 3 is a unit that ejects the ink (one example of a "liquid") within the cavity 245 (one example of a "pressure chamber") from nozzles N by driving of piezoelectric elements 200. The ejection unit 35 includes the nozzle plate 240 at which the nozzles N are formed, a cavity plate 242, a vibration plate 243, and a laminated piezoelectric element 201 in which the plurality of piezoelectric elements 200 is laminated.

The cavity plate 242 is formed in a predetermined shape (a shape in which a concave portion is formed), and, thus, the cavity 245 and a reservoir 246 are formed. The cavity 245 and the reservoir 246 communicates with an ink supplying opening 247. In addition, the reservoir 246 communicates with the ink cartridge the ink supply tube 311.

In FIG. 3, a lower end of the laminated piezoelectric element 201 is bonded to the vibration plate 243 through an intermediate layer 244. A plurality of outer electrodes 248 and a plurality of inner electrodes 249 are bonded to the laminated piezoelectric element 201. That is, the outer electrodes 248 are bonded to an outer surface of the laminated piezoelectric element 201, and the inner electrodes 249 are provided between the piezoelectric elements 200 constituting the laminated piezoelectric element 201 (or inside of each piezoelectric element). In this case, some of the outer electrodes 248 and the inner electrodes 249 are alternately arranged so as to be overlapped in a thickness direction of the piezoelectric element 200.

In addition, the laminated piezoelectric element 201 is deformed as indicated by arrow of FIG. 3 (expands and contracts in an up and down direction in FIG. 3) to vibrate by supplying the driving signal Vin between the outer electrodes 248 and the inner electrodes 249 from the driving signal generation unit 51, and the vibration plate 243 vibrates by the vibration. A volume of the cavity 245 (a pressure within the cavity) is changed by the vibration of the vibration plate 243, and the ink (the liquid) filled in the cavity 245 is ejected from the nozzles N as the liquid.

When the ink within the cavity 245 is reduced by the ejection of the ink, the ink is supplied from the reservoir 246. Moreover, the ink is supplied from the ink cartridge 31 through an ink supply tube 311 to the reservoir 246.

Figure 4:
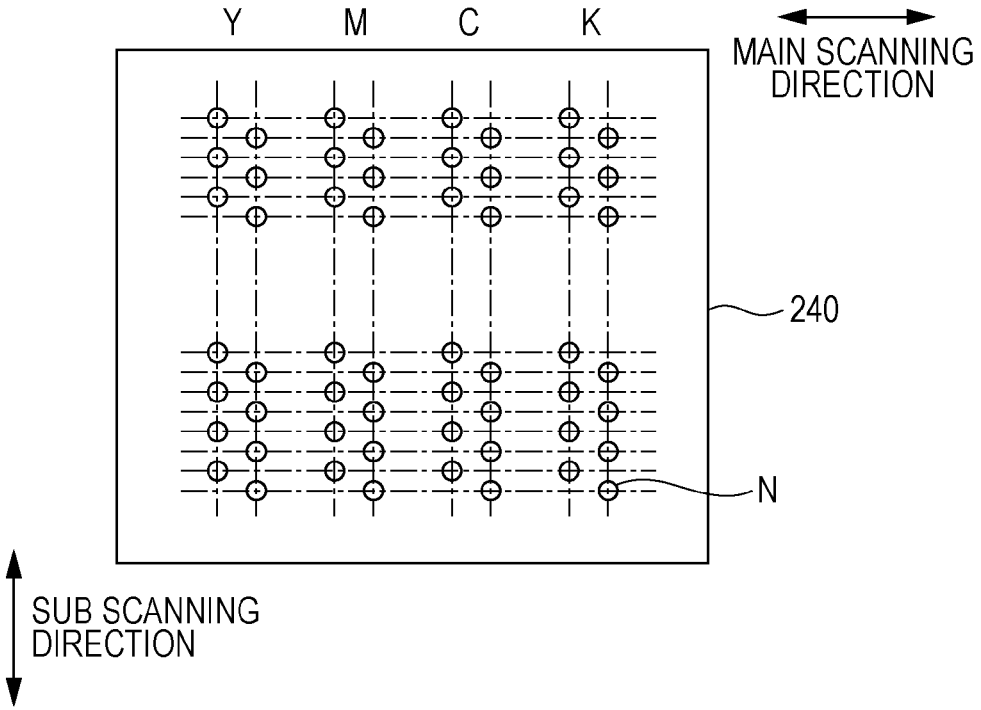
FIG. 4 is a plan view schematically illustrating a nozzle plate included in a head unit.

Further, an arrangement pattern of the nozzles N formed at the nozzle plate 240 illustrated in FIG. 3 is performed such that columns thereof are shifted like a nozzle arrangement pattern illustrated in FIG. 4. In addition, pitches between the nozzles N can be appropriately obtained according to printing resolution (dpi: dot per inch) Further, in FIG. 4, the arrangement pattern of the nozzles N is illustrated when the inks of four colors (the ink cartridges) are applied.

Figure 5:
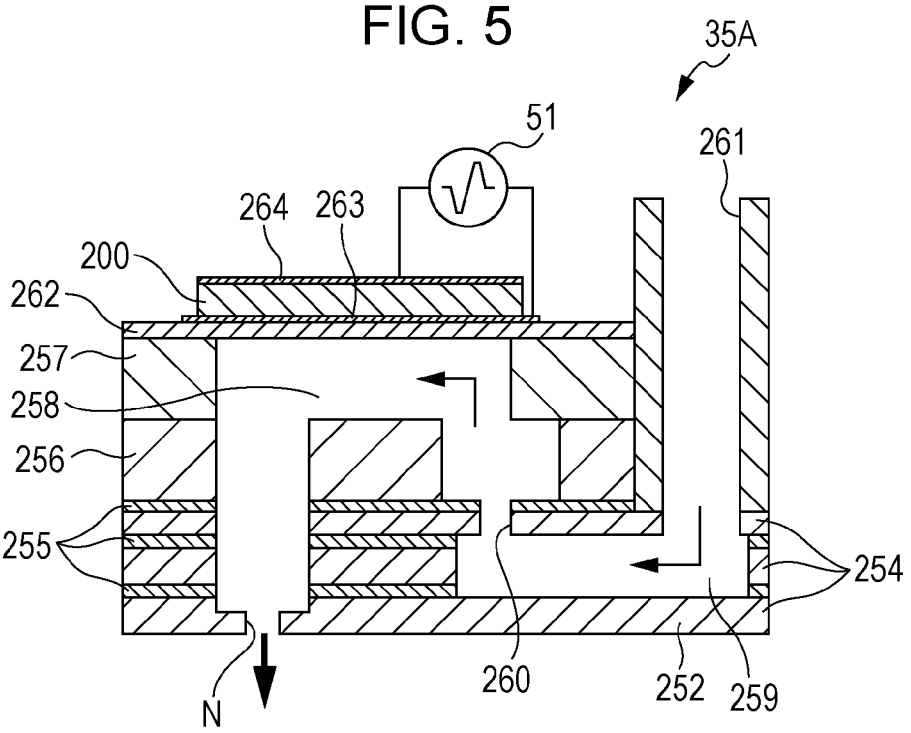
FIG. 5 is a cross-sectional view schematically illustrating an ejection unit.

Next, another example of the ejection unit will be described. An ejection unit 35A illustrated in FIG. 5 is a unit that ejects an ink (a liquid) within a cavity 258 from nozzles N by vibration of a vibration plate 262 caused by the vibration of the piezoelectric elements 200. A metal plate 254 made of stainless steel is bonded to a nozzle plate 252 at which the nozzles N are formed and which is made of stainless steel through an adhesive film 255, and a metal plate 254 made of the same stainless steel is bonded to the nozzle plate through an adhesive film 255. In addition, a communicating opening forming plate 256 and a cavity plate 257 are sequentially bonded to the metal plate.

The nozzle plate 252, the metal plate 254, the adhesive film 255, the communicating opening forming plate 256 and the cavity plate 257 are formed in a predetermined shape (a shape in which a concave portion is formed) and these plates are overlapped, so that a cavity 258 and a reservoir 259 are formed. The cavity 258 and the reservoir 259 communicate with an ink supplying opening 260. Moreover, the reservoir 259 communicates with an ink intake port 261.

The vibration plate 262 is provided at a top opening of the cavity plate 257, and the piezoelectric element 200 is bonded to the vibration plate 262 through lower electrodes 263. Moreover, upper electrodes 264 are bonded to an opposite side to the lower electrodes 263 of the piezoelectric element 200.

The driving signal generation unit 51 supplies the driving signal Vin between the upper electrodes 264 and the lower electrodes 263, and, thus the piezoelectric element 200 vibrates. The vibration plate 262 bonded to the piezoelectric element vibrates. The volume of the cavity 258 (the pressure within the cavity) is changed by the vibration of the vibration plate 262, and the ink (the liquid) filled within the cavity 258 is ejected through the nozzles N.

When the ink is ejected and the amount of ink within the cavity 258 is reduced, the ink is supplied from the reservoir 259. Moreover, the ink is supplied from the ink intake port 261 to the reservoir 259.

Figure 6A:
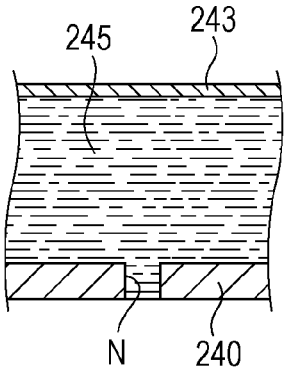
FIGS. 6A to 6C are explanatory diagrams for describing change in cross-sectional shape of the ejection unit when a driving signal is supplied.
Figure 6B:
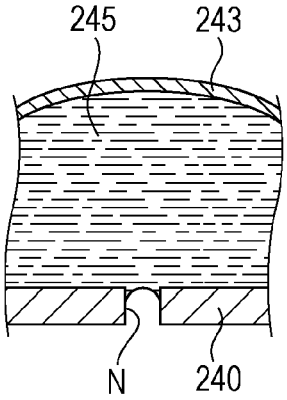
Figure 6C:
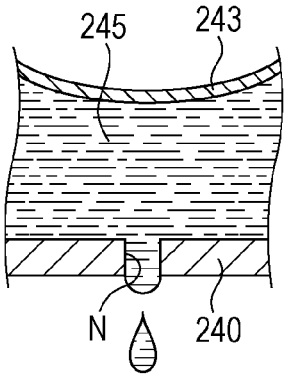

Next, the ejection of the ink will be described with reference to FIGS. 6A to 6C.

When the driving signal Vin is supplied to the piezoelectric element 200 illustrated in FIG. 3 (FIG. 5) from the driving signal generation unit 51, distortion proportional to an electric field applied between the electrodes occurs. Thus, the vibration plate 243 (262) is bent in the up and down direction of FIG. 3 (FIG. 5) from an initial state illustrated in FIG. 6A, and the volume of the cavity 245 (258) is increased as illustrated in FIG. 6B. In this state, when a voltage representing the driving signal Vin is changed under the control of the driving signal generation unit 51, the vibration plate 243 (262) is restored by an elastic restoring force, and moves downwards over a position of the vibration plate 243 (262) in the initial state. The volume of the cavity 245 (258) is rapidly contracted as illustrated in FIG. 6C. At this time, some of the ink filled in the cavity 245 (258) is ejected as ink droplets from the nozzles N that communicate with the cavity 245 (258) by a compression pressure generated within the cavity 245 (258).

The vibration plate 243 of the cavity 245 damping-vibrates until the subsequent ink ejecting operation starts after a series of ink ejecting operations are finished. Hereinafter, the damping-vibration is also referred to as residual vibration. It is assumed that the residual vibration of the vibration plate 243 has a natural vibration frequency determined by shapes of the nozzles N and the ink supplying opening 247, or an acoustic resistance r due to ink viscosity, an inertance m due to an ink weight within a flow path, and a compliance Cm of the vibration plate 243.

3. Regarding to Residual Vibration

A calculation model of the residual vibration of the vibration plate 243 based on the assumption will be described.

Figure 7:
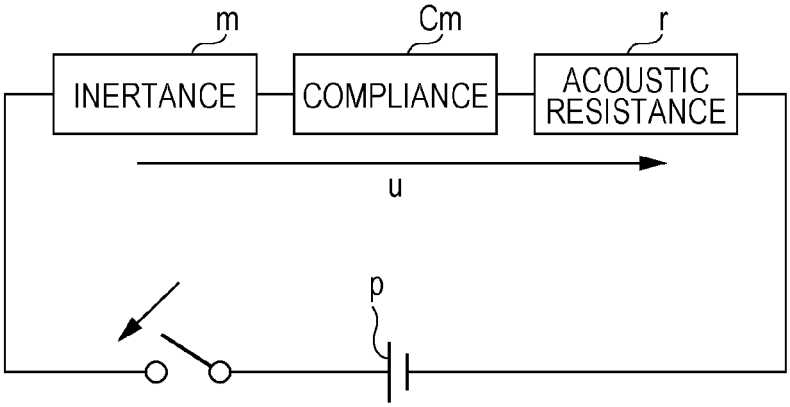
FIG. 7 is a circuit view illustrating a model of simple vibration indicating residual vibration in the ejection unit.

FIG. 7 is a circuit view illustrating the calculation model of simple harmonic vibration which assumes the residual vibration of the vibration plate 243.

As described above, the calculation model of the residual vibration of the vibration plate 243 is expressed by an acoustic pressure p, the aforementioned inertance m, acoustic resistance r and compliance Cm. Furthermore, if a step response is calculated for a volume velocity u when the acoustic pressure p is applied in the circuit of FIG. 7, the following equation is obtained.

$$u=\{p/(\omega\cdot m)\}e^{-\alpha t}\cdot\sin(\omega t)$$

$$\omega=\{1/(m\cdot Cm)-\alpha^2\}^{1/2}$$

$$\alpha=r/(2m)$$

Figure 8:
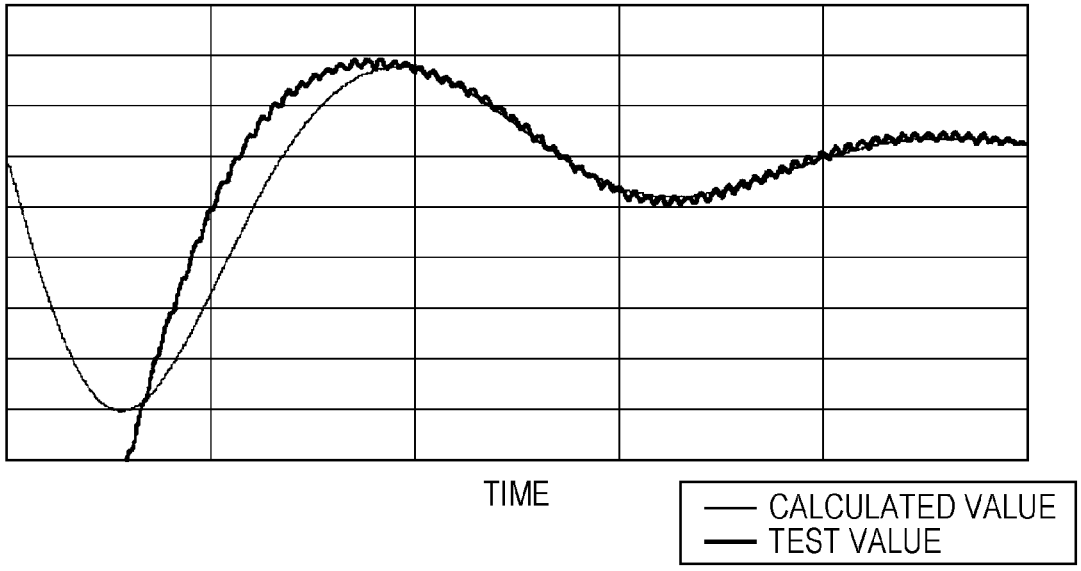
FIG. 8 is a graph illustrating a relationship between test values and calculated values of the residual vibration when the ejection state is normal in the ejection unit.

The calculation result obtained from the equation is compared with an experimental result in an experiment of the residual vibration of the vibration plate 243 after the ink droplets are separately ejected. FIG. 8 is a graph representing a relation between test values of the residual vibration of the vibration plate 243 and calculated values. As can be seen from the graph of FIG. 8, two waveforms of the test values and the calculated values roughly coincide.

In the ejection unit 35, a phenomenon where the ink droplets are not normally ejected from the nozzles N even though the ejecting operation described above is performed, that is, the ejection abnormality of the liquid droplets may occur. As a cause by which the ejection abnormality is generated, there are (1) mixing of bubbles into the cavity 245, (2) drying and thickening (adhering) of the ink in the vicinity of the nozzles N, and (3) attaching of paper powder in the vicinity of outlets of the nozzles N.

When the ejection abnormality is caused, as a result, the liquid droplets are not typically ejected from the nozzles N, that is, the non-ejection phenomenon of the liquid droplets is exhibited. In this case, dot omission of a pixel in an image printed on the recording paper P occurs. Moreover, when the ejection abnormality is caused, even though the liquid droplets are ejected from the nozzles N, the amount of the liquid droplets is too small, or a scattering direction (a trajectory) of the liquid droplets is deviated. Thus, since impact is not appropriately performed, the dot omission of the pixel appears. In this way, in the following description, the ejection abnormality of the liquid droplets is also referred to as "dot omission."

In the following description, based on the comparison result represented in FIG. 8, at least one value of the acoustic resistance r and the inertance m is adjusted so as to allow the calculated values of the residual vibration of the vibration plate 243 and the test values to match (roughly coincide) for each cause of the dot omission (ejection abnormality) phenomenon (liquid-droplet non-ejection phenomenon) occurring in the ejection unit 35 when the printing process is performed.

Figure 9:
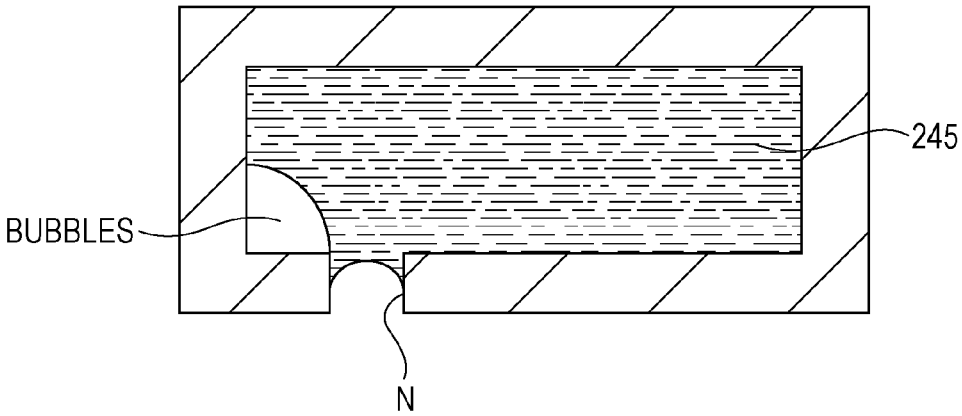
FIG. 9 is an explanatory diagram illustrating a state of the ejection unit when bubbles are mixed into the inside of a cavity.

Firstly, (1) the mixing of bubbles into the cavity 245 which is one cause of the dot omission is examined. FIG. 9 is a conceptual view in the vicinity of the nozzles N when the bubbles are mixed into the cavity 245. As illustrated in FIG. 9, it is assumed that the generated bubbles are generated and attached to a wall surface of the cavity 245.

As mentioned above, when the bubbles are mixed into the cavity 245, it is considered that the total weight of the ink filled in the cavity 245 is reduced and the inertance m is decreased. Moreover, as exemplified in FIG. 9, when the bubbles are attached in the vicinity of the nozzles N, it is considered that diameters of the nozzles N become larger by as much as diameters of the bubbles and the acoustic resistance r is decreased.

Figure 10:
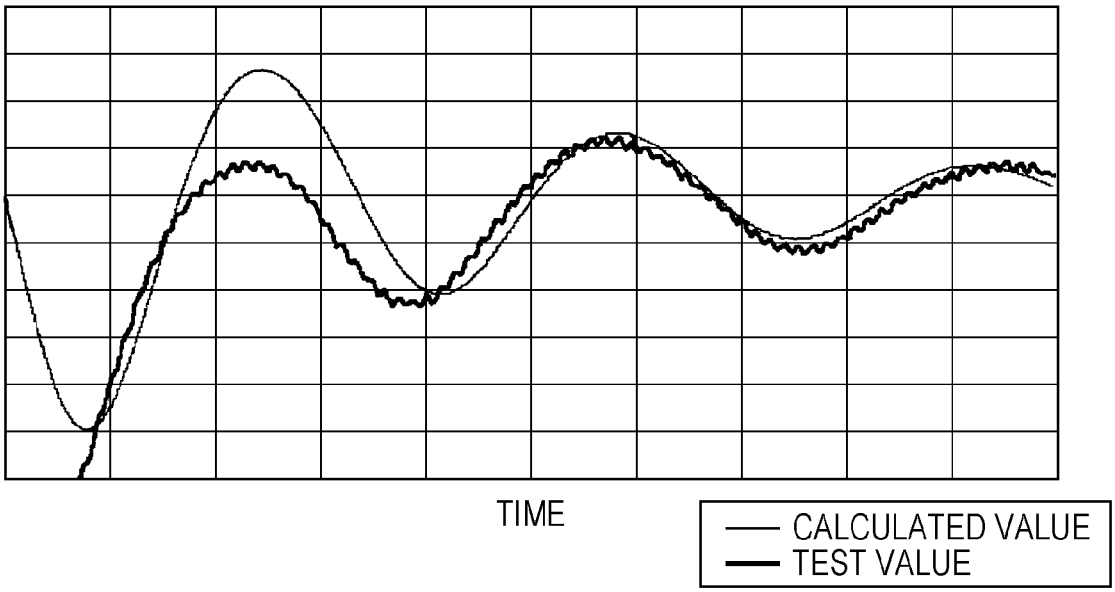
FIG. 10 is a graph illustrating test values and calculated values of the residual vibration in a state in which an ink cannot be ejected due to the mixture of bubbles into the inside of the cavity.

Accordingly, in the case of FIG. 8 where the ink is normally ejected, the acoustic resistance r and the inertance m are set to be small to match the test values of the residual vibration when the bubbles are mixed in, so that a result (a graph) represented in FIG. 10 is obtained. As can be seen from the graphs of FIGS. 8 and 10, when the bubbles are mixed into the cavity 245, a distinctive residual vibration waveform having a frequency higher than that in the case of normal ejection is obtained. Further, it can be seen that since the acoustic resistance r is decreased, a damping rate of the amplitude of the residual vibration is also decreased, so that the amplitude of the residual vibration is slowly decreased.

Figure 11:
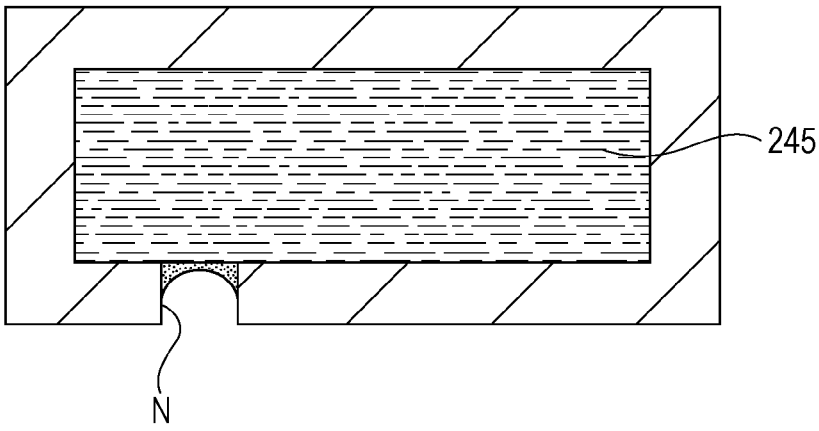
FIG. 11 is an explanatory diagram illustrating a state of the ejection unit when the ink is adhered to the vicinity of a nozzle.

Next, (2) the drying (fixation, thickening) of the ink in the vicinity of the nozzles N which is another cause of the dot omission is examined. FIG. 11 is a conceptual view in the vicinity of the nozzles N when the ink in the vicinity of the nozzles N of FIG. 3 adheres by drying. As illustrated in FIG. 11, when the ink in the vicinity of the nozzles N is dried and adheres, the ink within the cavity 245 is enclosed within the cavity 245. As stated above, when the ink in the vicinity of the nozzles N is dried and thickened, it is considered that the acoustic resistance r is increased.

Figure 12:
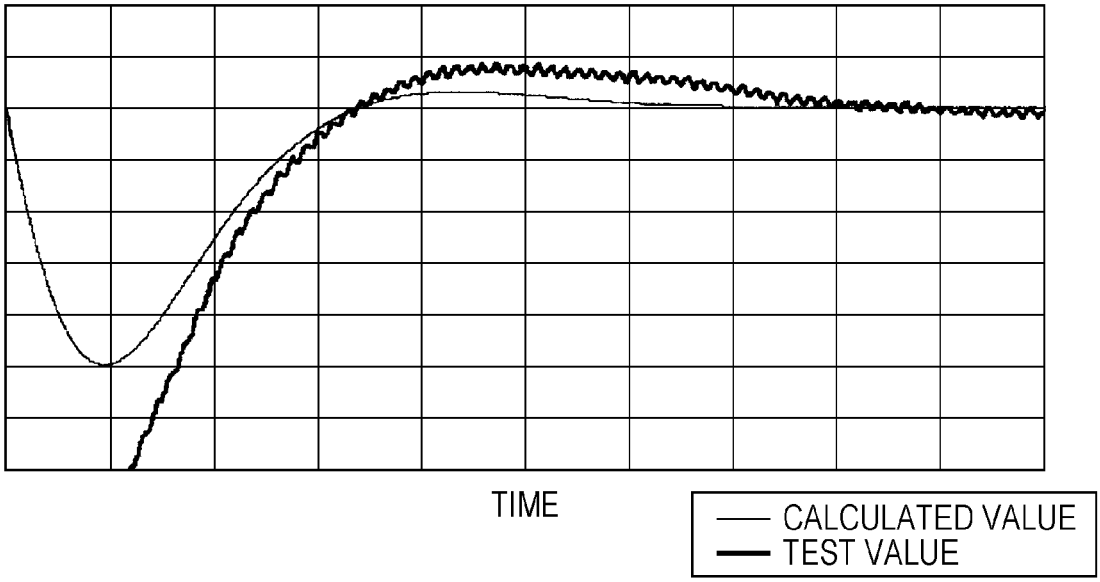
FIG. 12 is a graph illustrating test values and calculated values of the residual vibration in a state in which the ink cannot be ejected due to fixation of the ink to the vicinity of the nozzle.

Accordingly, in the case of FIG. 8 where the ink is normally ejected, the acoustic resistance r is set to be large to coincide with the test values of the residual vibration when the ink in the vicinity of the nozzles N is dried and adheres (thickened), so that a result (a graph) represented in FIG. 12 is obtained. Further, the test values represented in FIG. 12 are obtained by measuring the residual vibration of the vibration plate 243 while the ejection units 35 are placed without attaching caps (not illustrated) for several days and the ink is not ejected (the ink adheres) by drying and thickening of the ink in the vicinity of the nozzles N. As can be seen from the graphs of FIGS. 8 and 12, when the ink adheres by drying of the ink in the vicinity of the nozzles N, the frequency is extremely decreased as compared to the normal ejection, and the distinctive residual vibration waveform in which the residual vibration is over-damped is obtained. This is because after the ink is allowed to flow into the cavity 245 from the reservoir by pulling the vibration plate 243 upwards in FIG. 3 in order to eject the ink droplets, since there is no retreat route of the ink within the cavity 245 at the time of moving the vibration plate 243 downwards in FIG. 3, it is difficult for the vibration plate 243 to rapidly vibrate (over-damping).

Figure 13:
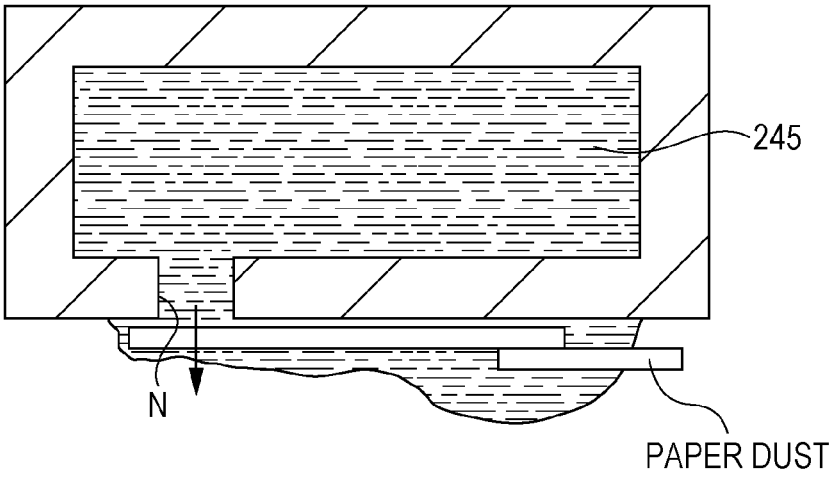
FIG. 13 is an explanatory diagram illustrating a state of the ejection unit in a case where paper dust is adhered to the vicinity of the outlet of the nozzle.

Next, (3) the attaching of paper powder in the vicinity of outlets of the nozzles N which is the other cause of the dot omission is examined. FIG. 13 is a conceptual view in the vicinity of the nozzles N when the paper powder is attached in the vicinity of the nozzles N of FIG. 3. As illustrated in FIG. 13, when the paper powder is attached in the vicinity of the nozzles N, the ink is exuded from the inside of the cavity 245 through the paper powder, and it is difficult to eject the ink from the nozzles N. As stated above, when the paper powder is attached in the vicinity of the nozzles N and the ink is exuded from the nozzles N, since the ink within the cavity 245 and the exuded ink are more increased than that of the normal state when viewed from the vibration plate 243, it is considered that the inertance m is increased. Moreover, it is considered that the acoustic resistance r is increased by fibers of the paper powder attached to the outlets of the nozzles N.

Figure 14:
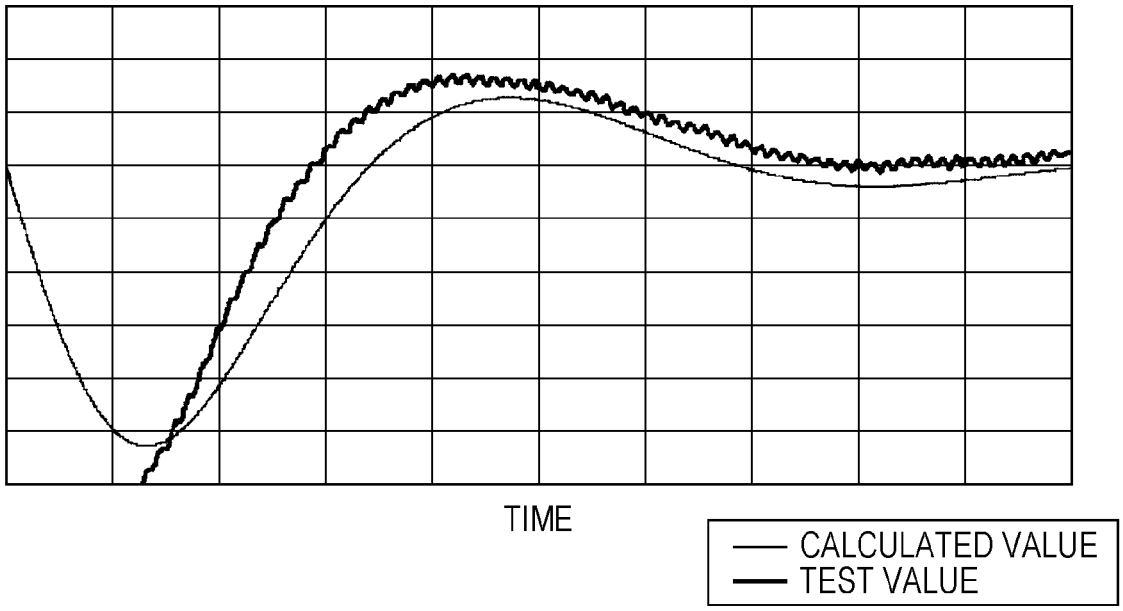
FIG. 14 is a graph illustrating test values and calculated values of the residual vibration in a state in which the ink cannot be ejected due to the adhesion of paper dust to the vicinity of the outlet of the nozzle.

Accordingly, in the case of FIG. 8 where the ink is normally ejected, the inertance m and the acoustic resistance r are set to be large to match the test values of the residual vibration when the paper powder is attached in the vicinity of the nozzles N, so that a result (a graph) of FIG. 14 is obtained. As can be seen from the graphs of FIGS. 8 and 14, when the paper powder is attached in the vicinity of the nozzles N, the distinctive residual vibration waveform having a frequency lower than that in the normal ejection is obtained.

Further, as can be seen from the graphs of FIGS. 12 and 14, when the paper powder is attached, the frequency of the residual vibration is higher than that when the ink is dried.

Here, the frequency of the damped vibration when the ink in the vicinity of the nozzles N is dried and thickened and also when the paper powder is attached in the vicinity of the outlets of the nozzles N is lower than that when the ink is normally ejected. In order to specify the causes of the two dot omission (ink non-ejection: ejection abnormality) from the waveform of the residual vibration of the vibration plate 243, it is possible to compare the frequency or the cycle of the damped vibration and the phase with predetermined threshold values, or specify a cycle change of the residual vibration (damped vibration) or the damping rate of the amplitude change. By doing this, it is possible to detect the ejection abnormality of the ejection unit 35 by the change of the residual vibration of the vibration plate 243, particularly, the change of the frequency thereof when the ink droplets are ejected from the nozzles N in the ejection unit 35. Moreover, by comparing the frequency of the residual vibration in this case with the frequency of the residual vibration in the normal ejection, it is possible to specify the causes of the ejection abnormality.

The ink jet printer 1 according to the invention analyzes the residual vibration to perform the ejection abnormality detecting process for detecting the ejection abnormality.

4. Configurations and Operations of Head Driver and Ejection Abnormality Detection Unit Next, the configurations and the operations of the head driver 50 (the driving signal generation unit 51 and the switching unit 53) and the ejection abnormality detection unit 52 will be described with reference to FIGS. 15 to 28.

Figure 15:
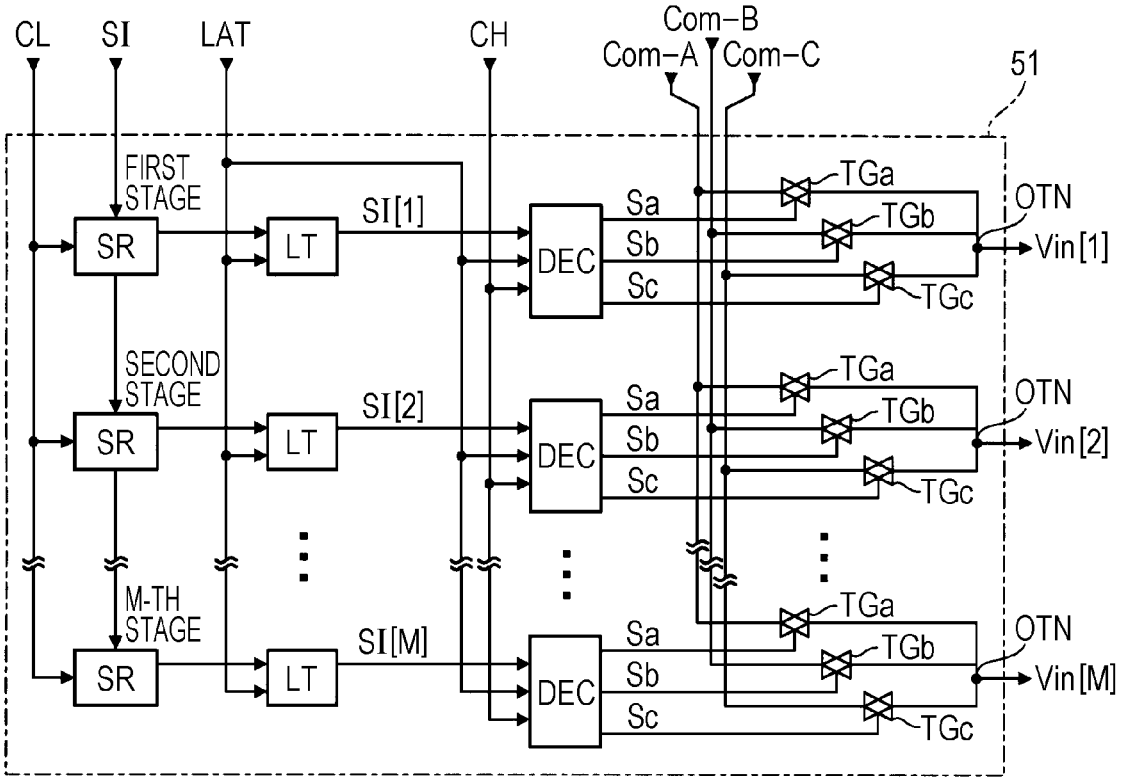
FIG. 15 is a block diagram illustrating the configuration of a driving signal generation unit.

FIG. 15 is a block diagram illustrating the configuration of the driving signal generation unit 51 of the head driver 50. As illustrated in FIG. 15, the driving signal generation unit 51 has M number of sets each including shift registers SR, latch circuits LT, decoders DEC, and transmission gates TGa, TGb and TGc so as to be in a one-to-one correspondence with the M number of ejection units 35. In the following description, the respective parts constituting the M number of sets are referred to as a first stage, a second stage, . . . , and a M-th stage in sequence from the top in the drawing (in FIG. 15, only the stages of the shift register SR are illustrated for purposes of simplifying illustration).

Further, although details will be described below, the ejection abnormality detection unit 52 includes M number of ejection abnormality detection circuits DT (DT[1], DT[2], . . . , and DT[M]) so as to be in a one-to-one correspondence with the M number of ejection units 35.

Clock signals CL, printing signals SI, latch signals LAT, change signals CH, and driving waveform signals Com (Com-A, Com-B and Com-C) are supplied to the driving signal generation unit 51, from the control unit 6.

Here, the printing signal SI is a digital signal that defines the amount of ink ejected from the ejection unit 35 (the nozzles N) in forming one dot of an image. More specifically, the printing signals SI according to the present embodiment are signals that define the amount of inks ejected from the ejection units 35 (the nozzles N) by 3 bits of a high-order bit b1, a middle-order bit b2 and a low-order bit b3, and are serially supplied to the driving signal generation unit 51 in synchronization with the clock signals CL from the control unit 6. By controlling the amount of inks ejected from the ejection units 35 by the printing signals SI, it is possible to express four gradation steps of non-recording, a small dot, a medium dot and a large dot in the respective dots of the recording paper P, and it is possible to generate the residual vibration to generate the driving signal Vin for inspection for inspecting the ejection state of the ink.

The shift registers SR temporarily hold the printing signals SI of 3 bits corresponding to the ejection units 35. Specifically, the M number of shift registers SR having the first stage, the second stage, . . . , and the M-th stage in a one-to-one correspondence with the M number of ejection units 35 are cascade-connected to each other, and the printing signals SI serially supplied are sequentially transferred to the subsequent stage in response to the clock signals CL. Furthermore, the supply of the clock signals CL is stopped at a point of time when the printing signals SI are transferred to all of the M number of shift registers SR, and each of the M number of shift registers SR maintains a state where each shift register holds data of 3 bits corresponding to each shift register among the printing signals SI.

The M number of latch circuits LT simultaneously latch the printing signals SI of 3 bits corresponding to the respective stages held by the respective M number of shift registers SR at a timing when the latch signals LAT rise. In FIG. 15, SI[1], SI[2], . . . , SI[M] are the printing signals SI of 3 bits latched by the latch circuits LT corresponding to the shift registers SR of first, second, . . . and M stages.

Incidentally, an operation period during which the ink jet printer 1 performs at least one process of the printing process, the ejection abnormality detecting process and the inspection waveform determining process includes a plurality of unit operation periods Tu. The unit operation period Tu includes a control period Ts1 and a control period Ts2 subsequent to the control period Ts1. In the present embodiment, the control periods Ts1 and Ts2 have an equal time length to each other.

Further, the plurality of unit operation periods Tu constituting the operation period may include four types of unit operation periods Tu that include a unit operation period Tu during which the printing process is performed, a unit operation period Tu during which the ejection abnormality detecting process is performed, a unit operation period Tu during which both of the printing process and the ejection abnormality detecting process are performed, and a unit operation period Tu during which the inspection waveform determining process is performed.

The control unit 6 supplies the printing signals SI during each unit operation period Tu to the driving signal generation unit 51, and controls the driving signal generation unit 51 to allow the latch circuits LT to latch the printing signals SI[1], SI[2], . . . , SI[M] during each unit operation period Tu. That is, the control unit 6 controls the driving signal generation unit 51 to supply the driving signals Vin to the M number of ejection unit 35 during each unit operation period Tu.

More specifically, when only the printing process is performed during the unit operation period Tu, the control unit 6 controls the driving signal generation unit 51 to supply the driving signals Vin for printing to the M number of ejection units 35. Thus, the M number of ejection units 35 eject the amount of inks corresponding to the image data Img on the recording paper P, and an image corresponding to the image data Img is formed on the recording paper P.

Meanwhile, when only the ejection abnormality detecting process is performed during the unit operation period Tu, the control unit 6 controls the driving signal generation unit 51 to supply the driving signals Vin for inspection to the M number of ejection units 35.

Moreover, when both of the printing process and the ejection abnormality detecting process are performed during the unit operation period Tu, the control unit 6 controls the driving signal generation unit 51 to supply the driving signals Vin for printing to some of the M number of ejection units 35 and to supply the driving signals Vin for inspection to the rest of the ejection units 35.

Further, when the inspection waveform determining process is performed during the unit operation period Tu, the control unit 6 controls the driving signal generation unit 51 to supply the driving signals Vin for inspection to the M number of ejection units 35. However, although details will be described below, in the inspection waveform determining process, the driving signals Vin for inspection supplied to the ejection units 35 are driving signals Vin for deciding the waveform of the driving signal Vin for inspection used in the ejection abnormality detecting process, and do not necessarily coincide with the driving signals Vin for inspection used in the ejection abnormality detecting process.

The decoder DEC decodes the printing signal SI of 3 bits latched by the latch circuit LT, and outputs selection signals Sa, Sb and Sc during each of the control periods Ts1 and Ts2.

FIG. 16 is an explanatory diagram (a table) illustrating the contents of decoding performed by the decoder DEC. As illustrated in the drawing, when the printing signals SI [m] corresponding to the m stages (m is a natural number which satisfies $1 \leq m \leq M$) indicate, for example, (b1, b2, b3)=(1, 0, 0), the decoders DEC of M stages set the selection signal Sa to a high level H and set the selection signals Sb and Sc to a low level L during the control period Ts1. In addition, the decoders set the selection signals Sa and Sc to a low level L and set the selection signal Sb to a high level H during the control period Ts2.

Moreover, when the low-order bit b3 is "1", that is, (b1, b2, b3)=(0, 0, 1), the decoders DEC of m stages set the selection signals Sa and Sb to a low level L and set the selection signal Sc to a high level H during the control periods Ts1 and Ts2.

The description returns to FIG. 15.

As illustrated in FIG. 15, the driving signal generation unit 51 includes M number of sets including transmission gates TGa, TGb and TGc. The M number of sets including transmission gates TGa TGb and TGc are provided in a one-to-one correspondence with the M number of ejection units 35.

The transmission gate TGa is turned on when the selection signal Sa is in a high level H, and is turned off when the selection signal Sa is in a low level L. The transmission gate TGb is turned on when the selection signal Sb is in a high level H, and is turned off when the selection signal Sb is in a low level L. The transmission gate TGc is turned on when the selection signal Sc is in a high level H, and is turned off when the selection signal Sc is in a low level L.

For example, in the m-th stage, when the content indicated by the printing signal Si[m] is (b1, b2, b3)=(1, 0, 0), the transmission gate TGa is turned on and the transmission gates TGb and TGc are turned off during the control period Ts1, and the transmission gate TGb is turned on and the transmission gates TGb and TGc are turned off during the control period Ts2.

The driving waveform signal Com-A is supplied to one terminal of the transmission gate TGa, the driving waveform signal Com-B is supplied to one terminal of the transmission gate TGb, and the driving waveform signal Com-C is supplied to one terminal of the transmission gate TGc. Moreover, the other terminals of the transmission gates TGa, TGb and TGc are commonly connected to an output terminal OTN to the switching unit 53.

The transmission gates TGa, TGb and TGc are exclusively turned on, and the driving waveform signal Com-A, Com-B or Com-C selected for the control periods Ts1 and Ts2 are output to the output terminal OTN, as the driving signals Vin[m], and supplied to the ejection unit 35 of the m-th stage through the switching unit 53.

Figure 17:
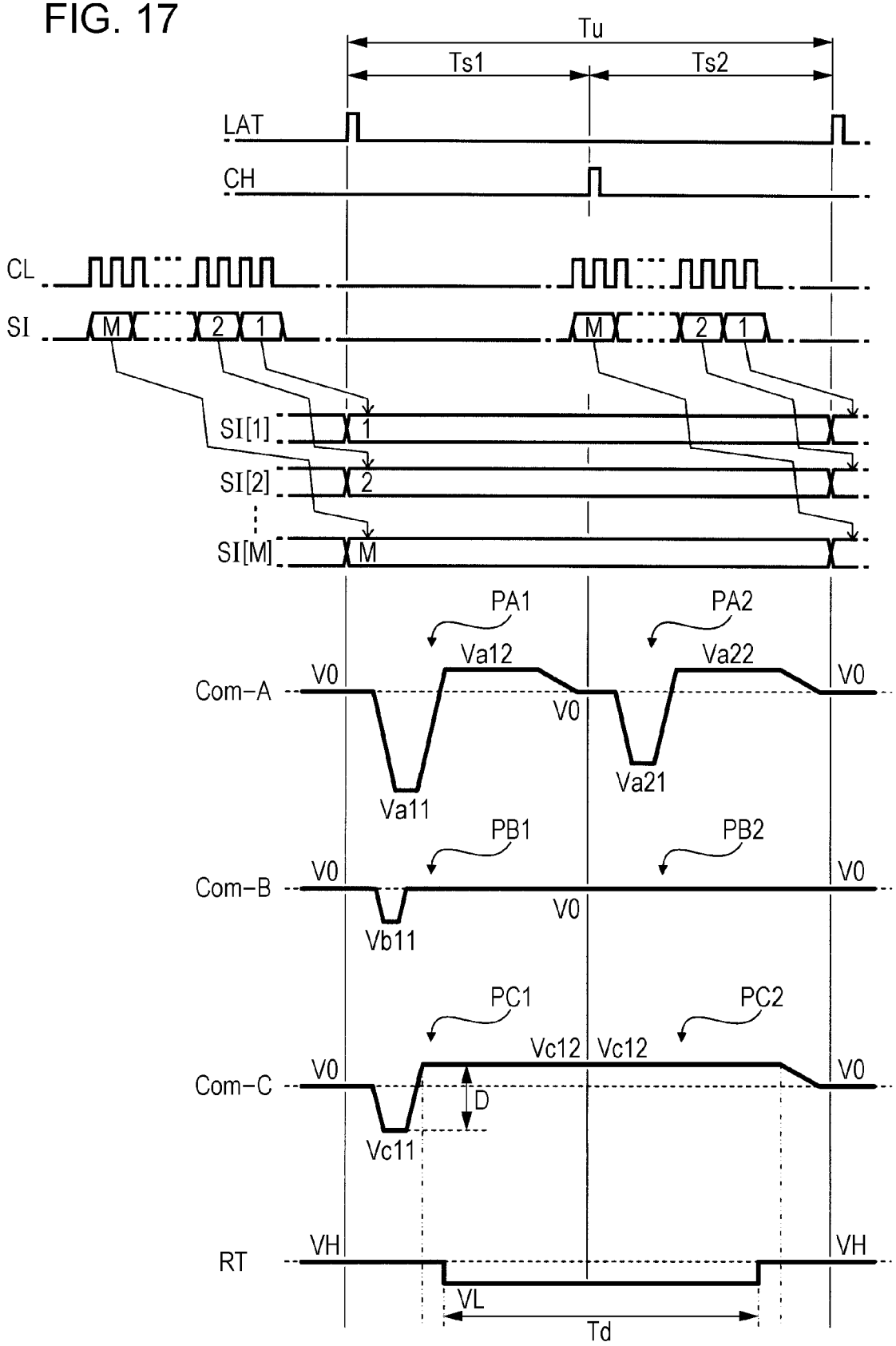
FIG. 17 is a timing chart illustrating an operation of the driving signal generation unit in a unit operation period.

FIG. 17 is a timing chart for describing the operation of the driving signal generation unit 51 during the unit operation period Tu. As illustrated in FIG. 17, the unit operation period Tu is defined by the latch signal LAT output from the control unit 6. Moreover, the control periods Ts1 and Ts2 included in the unit operation period Tu are defined by the latch signal LAT and the change signal CH output from the control unit 6.

The driving waveform signal Com-A supplied from the control unit 6 during the unit operation period Tu is a signal for generating the driving signal Vin for printing, and has a waveform that continuously connects a unit waveform PA1 disposed in the control period Ts1 of the unit operation period Tu and a unit waveform PA2 disposed in the control period Ts2 as illustrated in FIG. 17. Potentials at a timing when the unit waveform PA1 and the unit waveform PA2 start and end are both reference potentials V0. Moreover, as illustrated in the drawing, a potential difference between a potential Va11 and a potential Va12 of the unit waveform PA1 is larger than a potential difference between a potential Va21 and a potential Va22 of the unit waveform PA2. For this reason, the amount of the ink ejected from the nozzles N included in the ejection unit 35 when the piezoelectric elements 200 included in the ejection unit 35 are driven by the unit waveform PA1 is larger than the amount of the ink ejected when the piezoelectric elements are driven by the unit waveform PA2.

The driving waveform signal Com-B supplied from the control unit 6 during the unit operation period Tu is a signal for generating the driving signal Vin for printing, and has a waveform that continuously connects a unit waveform PB1 disposed in the control period Ts1 and a unit waveform PB2 disposed in the control period Ts2.

Potentials at a timing when the unit waveform PB1 starts and ends are both reference potentials V0, and the unit waveform PB2 is maintained at the reference potential V0 over the control period Ts2. Moreover, a potential difference between a potential Vb11 of the unit waveform PB1 and a reference potential V0 is smaller than a potential difference between a potential Va21 and a potential Va22 of the unit waveform PA2. In addition, even when the piezoelectric elements 200 included in the ejection unit 35 are driven by the unit waveform PB1, the ink is not ejected from the nozzles N included in the ejection unit 35. Similarly, even when the unit waveform PB2 is supplied to the piezoelectric elements 200, the ink is not ejected from the nozzles N.

The driving waveform signal Com-C supplied from the control unit 6 during the unit operation period Tu is a signal for generating the driving signal Vin for inspection, and has a waveform that continuously connects a unit waveform PC1 disposed in the control period Ts1 and a unit waveform PC2 disposed in the control period Ts2. A potential at a timing when the unit waveform PC1 starts and a potential at a timing when the unit waveform PC2 ends are both reference potentials V0. The potential of the unit waveform PC1 is changed from the reference potential V0 to a potential Vc11, and is then changed from the potential Vc11 to a potential Vc12. Thereafter, the potential of the unit waveform PC1 is maintained at the potential Vc12 until the control period Ts1 ends.

Moreover, the potential of the unit waveform PC2 is maintained at the potential Vc12, and is then changed from the potential Vc12 to the reference potential V0 before the control period Ts2 ends. A driving voltage D which is a potential difference between the potential Vc11 and the potential Vc12 is set to a voltage so as not to eject the ink from the nozzles N included in the ejection unit 35 by the inspection waveform determining process to be described below even when the piezoelectric elements 200 included in the ejection unit 35 are driven by the unit waveform PC1 (and the unit waveform PC2).

As illustrated in FIG. 17, the m number of latch circuits Lt output the printing signals SI[1], SI[2], . . . , and SI[M] at a timing when the latch signals LAT rise, that is, at a timing when the unit operation period Tu starts.

Further, the m-th stage decoder DEC outputs selection signals Sa, Sb, and Sc based on the contents of the table illustrated in FIG. 16 in respective control periods Ts1 and Ts2 according to the printing signal SI[m] as described above.

Moreover, as described above, the transmission gates TGa, TGb and TGc of the m-th stage select any one of the driving waveform signals Com-A, Com-B and Com-C based on the selection signals Sa, Sb, and Sc, and output the selected driving waveform signal Com as the driving signal Vin[m].

Further, a switching period designation signal RT illustrated in FIG. 17 is a signal that defines a switching period Td. The switching period designation signal RT and the switching period Td will be described below.

A waveform of the driving signal Vin output from the driving signal generation unit 51 during the unit operation period Tu will be described with reference to FIG. 18 in addition to FIGS. 15 to 17.

Since the printing signal SI[m] supplied during the unit operation period Tu indicates (b1, b2, b3)=(1, 1, 0), since the selection signals Sa, Sb and Sc are in a high level H, a low level L, and a low level L during the control period Ts1, the driving waveform signal Com-A is selected by the transmission gate TGa, and the unit waveform PA1 is output as the driving signal Vin[m]. Moreover, similarly to the control period Ts1, during the control period Ts2, the driving waveform signal Com-A is selected by the transmission gate TGa, and the unit waveform PA2 is output as the driving signal Vin[m].

Figure 18:
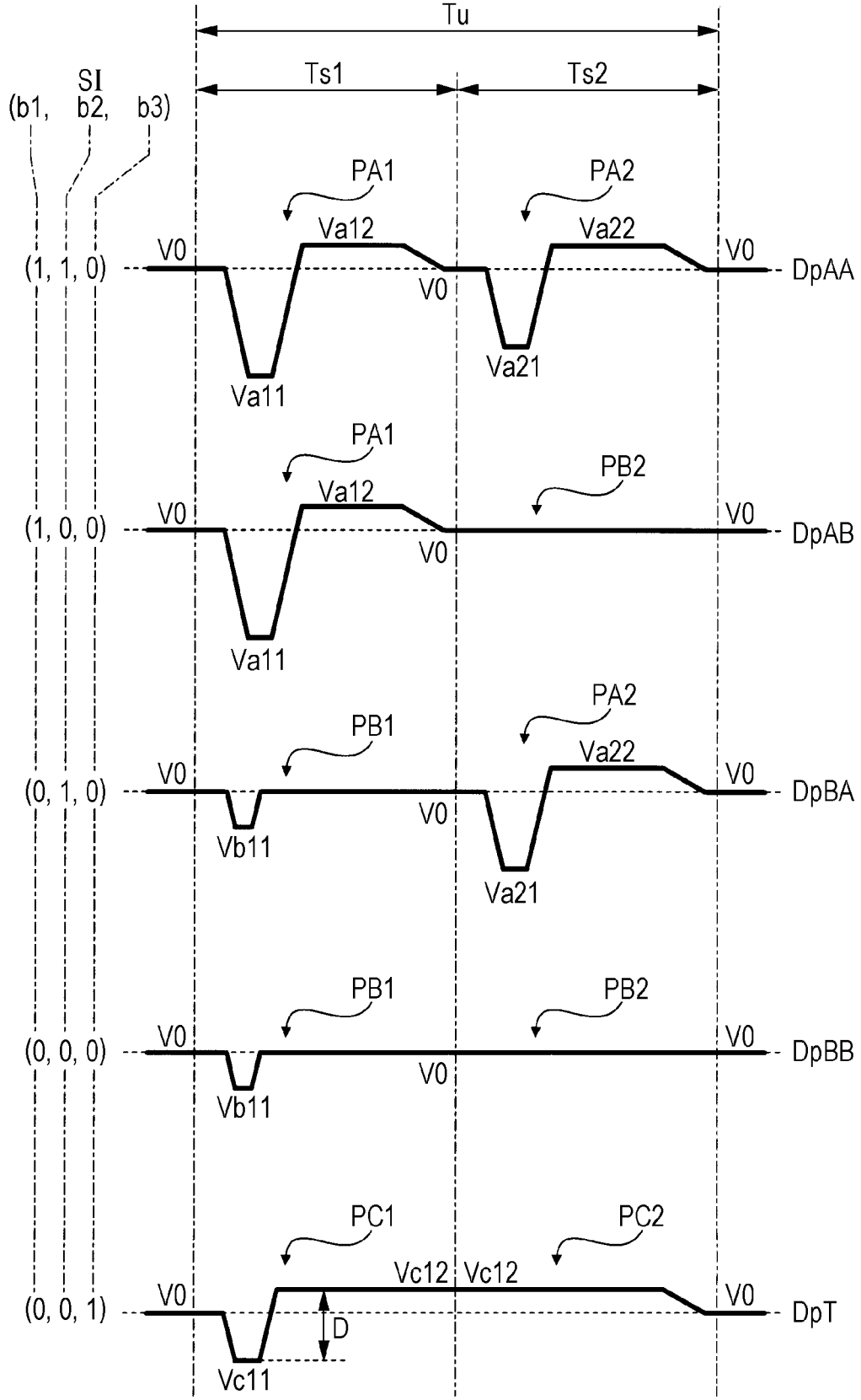
FIG. 18 is a timing chart illustrating a waveform of a driving signal in the unit operation period.

That is, when the printing signal SI[m] indicates (b1, b2, b3)=(1, 1, 0), the driving signal Vin[m] supplied to the ejection unit 35 of the m-th stage during the unit operation period Tu is the driving signal Vin for printing, and as illustrated in FIG. 18, a waveform thereof is a waveform DpAA including the unit waveform PA1 and the unit waveform PA2. As a result, during the unit operation period Tu, the ejection unit 35 of the m-th stage performs ejection of the medium amount of ink based on the unit waveform PA1 and ejection of the small amount of ink based on the unit waveform PA2, and the inks ejected twice are united on label paper P, so that a large dot is formed on the label paper P.

When the printing signal SI[m] supplied during the unit operation period Tu indicates (b1, b2, b3)=(1, 0, 0), since the selection signals Sa, Sb and Sc are in a high level H, a low level L and a low level L during the control period Ts1, the driving waveform signal Com-A is selected by the transmission gate TGa, and the unit waveform PA1 is output as the driving signal Vin[m]. Moreover, since the selection signals Sa, Sb and Sc are in a low level L, a high level H and low level L during the control period Ts2, the driving waveform signal Com-B is selected by the transmission gate TGb, and the unit waveform PB2 is output as the driving signal Vin[m].

That is, when the printing signal SI[m] indicates (b1, b2, b3)=(1, 0, 0), the driving signal Vin[m] supplied to the ejection unit 35 of the m-th stage during the unit operation period Tu is the driving signal Vin for printing, and as illustrated in FIG. 18, a waveform thereof is a waveform DpAB including the unit waveform PA1 and the unit waveform PB2. As a result, the ejection unit 35 of the m-th stage performs ejection of the medium amount of ink based on the unit waveform PA1 during the unit operation period Tu, so that a medium dot is formed on the label paper P.

When the printing signal SI[m] supplied during the unit operation period Tu indicates (b1, b2, b3)=(0, 1, 0), since the selection signals Sa, Sb and Sc are in a low level L, a high level H and a low level L during the control period Ts1, the driving waveform signal Com-B is selected by the transmission gate TGb, and the unit waveform PB1 is output as the driving signal Vin[m]. Moreover, since the selection signals Sa, Sb and Sc are in a high level H, a low level L and a low level L during the control period Ts2, the driving waveform signal Com-A is selected by the transmission gate TGa, and the unit waveform PA2 is output as the driving signal Vin[m].

That is, when the printing signal SI[m] indicates (b1, b2, b3)=(0, 1, 0), the driving signal Vin[m] supplied to the ejection unit 35 of the m-th stage during the unit operation period Tu is the driving signal Vin for printing, and as illustrated in FIG. 18, a waveform thereof is a waveform DpBA including the unit waveform PB1 and the unit waveform PA2. As a result, the ejection unit 35 of the m-th stage performs ejection of the small amount of ink based on the unit waveform PA2 during the unit operation period Tu, and a small dot is formed on the label paper P.

When the printing signal SI[m] supplied during the unit operation period Tu indicates (b1, b2, b3)=(0, 0, 0), the selection signals Sa, Sb and Sc are in a low level L, a high level H and low level L during the control period Ts1, the driving waveform signal Com-B is selected by the transmission gate TGb, and the unit waveform PB1 is output as the driving signal Vin[m]. Moreover, similarly to the control period Ts1, the driving waveform signal Com-B is selected by the transmission gate TGb during the control period Ts2, and the unit waveform PB2 is output as the driving signal Vin[m].

That is, when the printing signal SI[m] indicates (b1, b2, b3)=(0, 0, 0), the driving signal Vin[m] supplied to the ejection unit 35 of the m-th stage during the unit operation period Tu is the driving signal Vin for printing, and as illustrated in FIG. 18, a waveform thereof is a waveform DpBB including the unit waveform PB1 and the unit waveform PB2. As a result, the ink is not ejected from the ejection unit 35 of the m-th stage during the unit operation period Tu, and the dot is not formed on the label paper P (non-recording).

When the printing signal SI[m] supplied during the unit operation period Tu indicates (b1, b2, b3)=(0, 0, 1), since the selection signals Sa, Sb and Sc are in a low level L, a low level L and a high level H, the driving waveform signal Com-C is selected by the transmission gate TGc during the control period Ts1, and the unit waveform PC1 is output as the driving signal Vin[m]. Moreover, similarly to the control period Ts1, the driving waveform signal Com-C is selected by the transmission gate TGc during the control period Ts2, and the unit waveform PC2 is output as the driving signal Vin[m].

That is, when the printing signal SI[m] indicates (b1, b2, b3)=(0, 0, 1), the driving signal Vin[m] supplied to the ejection unit 35 of the m-th stage during the unit operation period Tu is the driving signal Vin for inspection, and as illustrated in FIG. 18, a waveform thereof is a waveform DpT including the unit waveform PC1 and the unit waveform PC2.

Further, the waveform DpT (magnitude of the driving voltage D) is determined as a waveform such that the ink is not ejected from the ejection unit 35 even though the driving signal Vin having the waveform DpT is supplied to the ejection unit 35 in the inspection waveform determining process.

Figure 19:
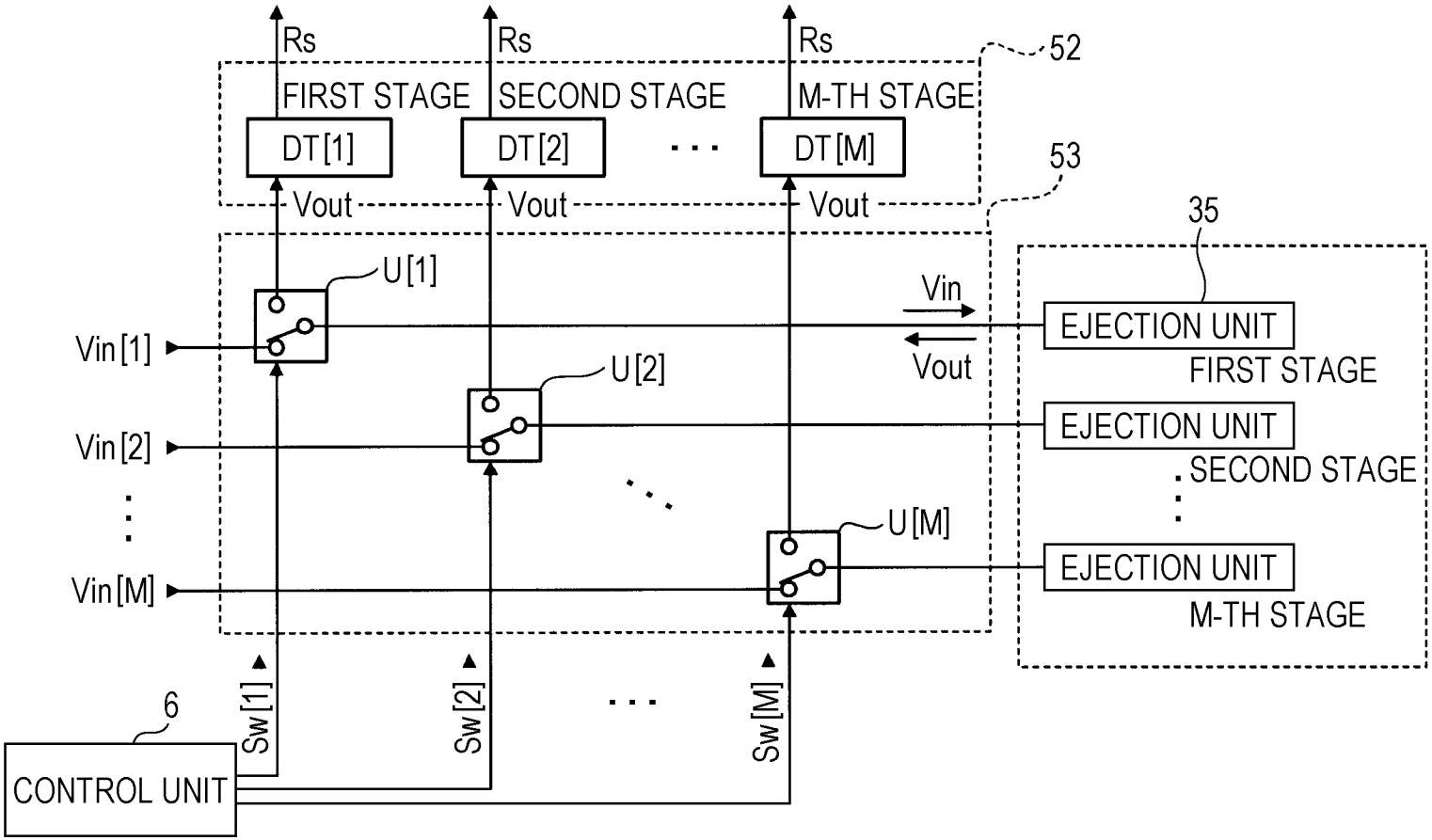
FIG. 19 is a block diagram illustrating the configuration of a switching unit.

FIG. 19 is a block diagram illustrating a configuration of the switching unit 53 of the head driver 50 and electric connection relations between the switching unit 53 and the ejection abnormality detection unit 52, head unit 30 and driving signal generation unit 51.

As illustrated in FIG. 19, the switching unit 53 includes M number of switching circuits U (U[1], U[2], . . . , and U[M]) having first to M-th stages corresponding to the M number of ejection units 35. Moreover, the ejection abnormality detection unit 52 includes M number of ejection abnormality detection circuits DT (DT[q], DT[q], . . . , and DT[q]) having first to M-th stages corresponding to the M number of ejection units 35.

The switching circuit U[m] of the m-th stage electrically connects the piezoelectric elements 200 of the ejection unit 35 of the m-th stage to any one of an output terminal OTN of the m-th stage included in the driving signal generation unit 51 and the ejection abnormality detection circuit DT[m] of the m-th stage included in the ejection abnormality detection unit 52.

In the following description, in the switching circuits U, a state where the ejection unit 35 and the output terminal OTN of the driving signal generation unit 51 are electrically connected is referred to as a first connection state. Moreover, a stage where the ejection unit 35 and the ejection abnormality detection circuit DT of the ejection abnormality detection unit 52 are electrically connected is referred to as a second connection state.

The control unit 6 outputs the switching control signals Sw for controlling the connection states of the switching circuits U to the switching circuits U.

Specifically, when the ejection unit 35 of the m-th stage is used to perform the printing process during the unit operation period Tu, the control unit 6 supplies the switching control signal Sw[m] to the switching circuit U[m] so as to allow the switching circuit U[m] corresponding to the ejection unit 35 of the m-th stage to maintain the first connection state over the entire period of the unit operation period Tu.

Meanwhile, when the ejection unit 35 of the m-th stage is a target of the ejection abnormality detecting process during the unit operation period Tu, the control unit 6 supplies the switching control signal Sw[m] to the switching circuit U[m] so as to allow the switching circuit U[m] corresponding to the ejection unit 35 of the m-th stage to enter the first connection state during a period other than the switching period Td of the unit operation period Tu and to enter the second connection state during the switching period Td of the unit operation period Tu. For this reason, the driving signal Vin is supplied to the ejection unit 35 which becomes the target of the ejection abnormality detecting process (or the inspection waveform determining process) from the driving signal generation unit 51 during the period other than the switching period Td of the unit operation period Tu, and the residual vibration signal Vout is supplied to the ejection abnormality detection circuit DT from the ejection unit 35 during the switching period Td of the unit operation period Tu.

Further, as illustrated in FIG. 17, the switching period Td is a period during which the switching period designation signal RT generated by the control unit 6 is set to a potential VL. Specifically, the switching period Td is a period determined such that a period of the unit operation period Tu becomes a partial period or the entire period of a period during which the driving waveform signal Com-C (that is, the waveform DpT) maintains the potential Vc12.

The ejection abnormality detection circuit DT detects a change of electromotive force of the piezoelectric elements 200 of the ejection unit 35 to which the driving signal Vin for inspection is supplied during the switching period Td, as the residual vibration signal Vout.

Figure 20:
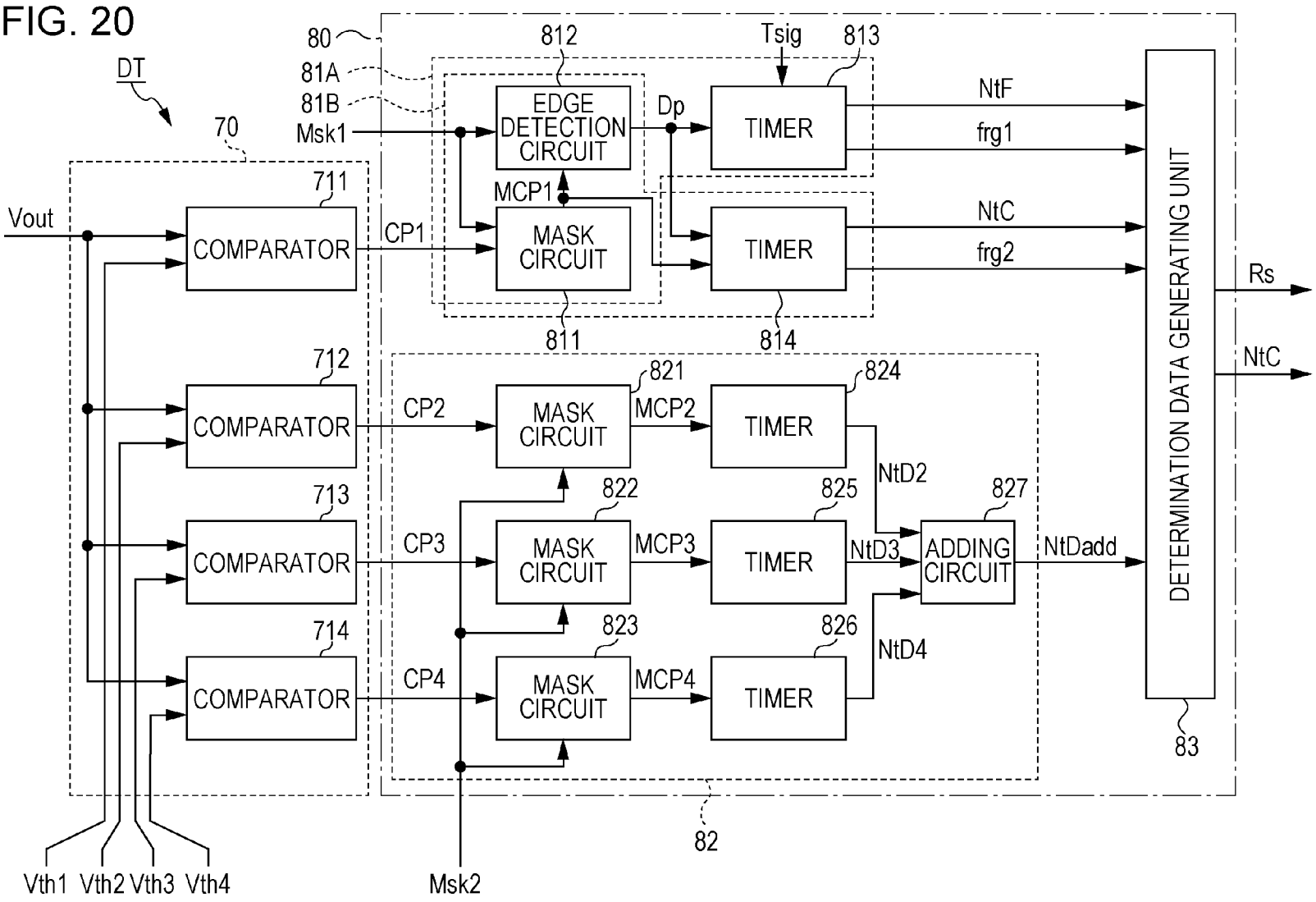
FIG. 20 is a block diagram illustrating the configuration of an ejection abnormality detection circuit.

FIG. 20 is a block diagram illustrating a configuration of the ejection abnormality detection circuit DT included in the ejection abnormality detection unit 52.

As illustrated in FIG. 20, the ejection abnormality detection circuit DT includes a comparison signal generation unit 70 to which the residual vibration signal Vout is supplied and a determination unit 80 that determines the state of nozzles based on the comparison results of the comparison unit 70. Further, the residual vibration signal Vout may be supplied to the comparison signal generation unit 70 by performing a waveform shaping process or the like without being directly supplied to the comparison signal generation unit 70. In this case, in the waveform shaping process, it is preferable to remove noise components by limiting the frequency range of the residual vibration signal Vout using a high-pass filter for outputting a signal in which a low-band frequency component lower than a frequency band of the residual vibration signal Vout is damped or a low-pass filter for outputting a signal in which a high-band frequency component higher than the frequency band of the residual vibration signal Vout is damped. In this manner, the signal from which noise components are removed is the residual vibration signal Vout.

The comparison signal generation unit 70 includes comparators 711 to 714. The comparator 711 compares the residual vibration signal Vout with a first threshold potential Vth1 and outputs a first comparison signal CP1 which is in a high level when the level of the residual vibration signal Vout is lower than the first threshold potential Vth1 and is in a low level when the level of the residual vibration signal Vout is higher than or equal to the first threshold potential Vth1.

The comparator 712 compares the residual vibration signal Vout with a second threshold potential Vth2 and outputs a second comparison signal CP2 which is in a high level when the amplitude of the residual vibration signal Vout becomes larger and the level of the residual vibration signal Vout is lower than the second threshold potential Vth2 and is in a low level when the level of the residual vibration signal Vout is higher than or equal to the second threshold potential Vth2.

The comparator 713 compares the residual vibration signal Vout with a third threshold potential Vth3 and outputs a third comparison signal CP3 which is in a high level when the amplitude of the residual vibration signal Vout becomes larger and the level of the residual vibration signal Vout is lower than the third threshold potential Vth3 and is in a low level when the level of the residual vibration signal Vout is higher than or equal to the third threshold potential Vth3.

The comparator 714 compares the residual vibration signal Vout with a fourth threshold potential Vth4 and outputs a fourth comparison signal CP4 which is in a high level when the amplitude of the residual vibration signal Vout becomes larger and the level of the residual vibration signal Vout is lower than the fourth threshold potential Vth4 and is in a low level when the level of the residual vibration signal Vout is higher than or equal to the fourth threshold potential Vth4.

Figure 21:
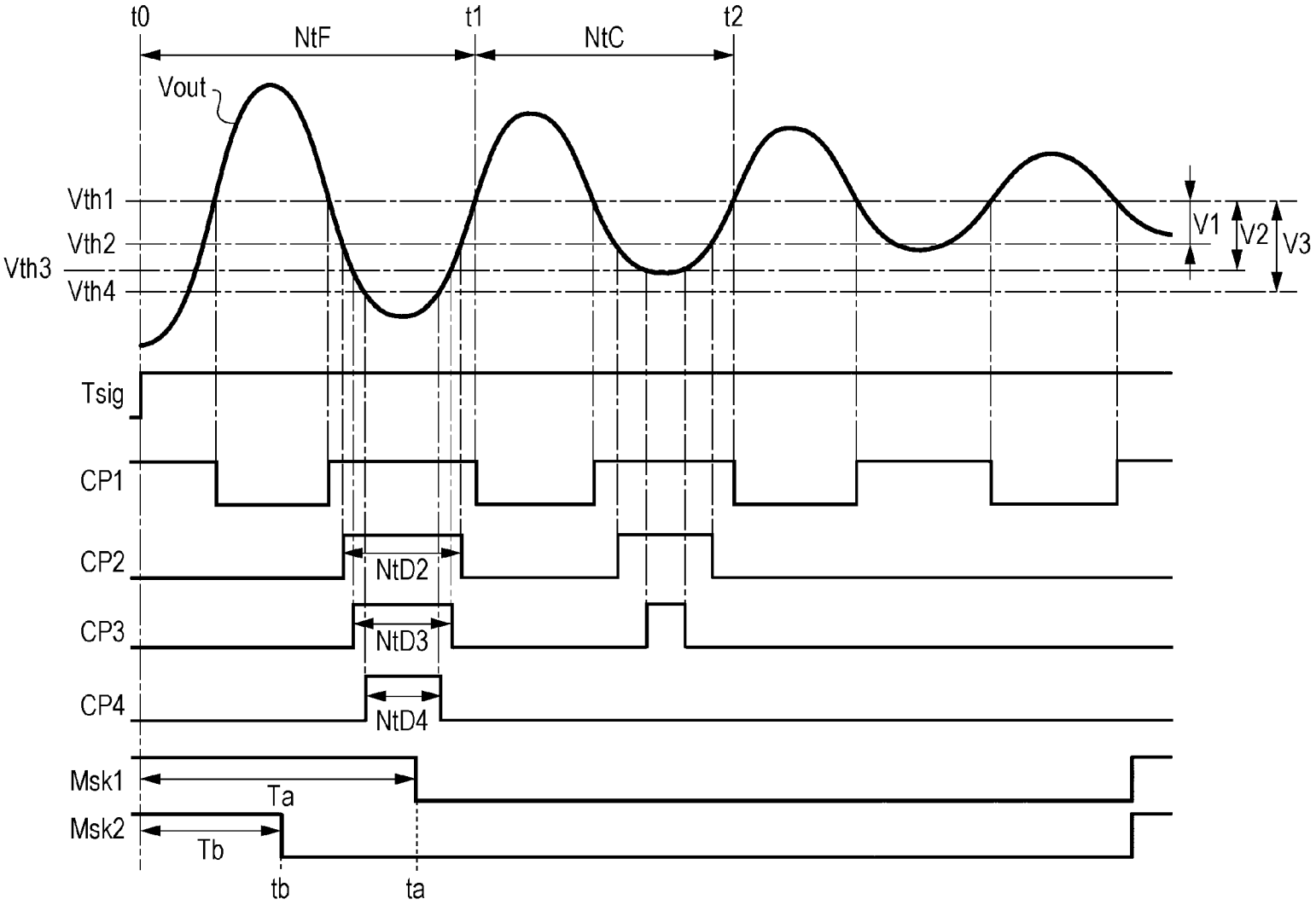
FIG. 21 is a timing chart illustrating an operation of the ejection abnormality detection circuit.
Figure 22:
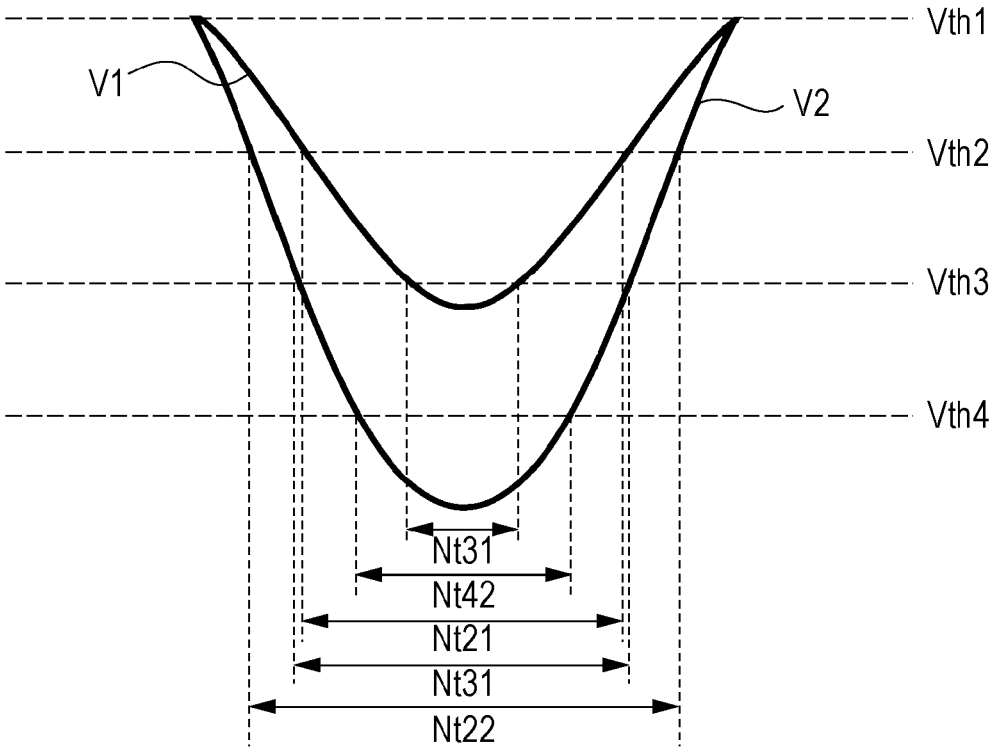
FIG. 22 is an explanatory diagram illustrating a relationship between a residual vibration signal and first to fourth threshold potentials.

FIG. 21 is a timing chart illustrating the residual vibration signal Vout, the first to fourth threshold values Vth1 to Vth4, and the first to fourth comparison signals CP1 to CP4. As illustrated in FIG. 21, the first threshold potential Vth1 substantially coincides with the amplitude center level of the residual vibration signal Vout. Here, the amplitude center level of the residual vibration signal Vout means a level of the residual vibration signal Vout in a state in which the residual vibration is substantially damped and converged and an external force is not applied to the piezoelectric element 200 which is a generation source of the amplitude.

The comparator 711 has hysteresis properties. That is, strictly, the first comparison signal CP1 is in a high level when the level of the residual vibration signal Vout exceeds Vth1−ΔV and is transitioned in the negative direction and the first comparison signal CP1 is in a low level when the level of the residual vibration signal Vout exceeds Vth1+ΔV and is transitioned in the positive direction. Therefore, in a case where the amplitude of the residual vibration signal Vout is in the range of Vth1−ΔV to Vth1+ΔV, the first comparison signal CP1 is in a low level.

The residual vibration is changed by the ejection state of the nozzle N. For example, when an ink is thickened at the tip of the nozzle N or the nozzle N is blocked by foreign matters, the residual vibration is hardly generated even when the driving waveform signal is applied to the piezoelectric element 200. In such a case, the amplitude of the residual vibration signal Vout becomes extremely small so that the amplitude is barely in the vicinity of the amplitude center level. Accordingly, even when the residual vibration signal Vout is binarized with the first threshold potential Vth1, chattering is only generated in the first comparison signal CP1 and useful information cannot be obtained. ΔV is determined in consideration of the noise level of the residual vibration signal Vout and set such that the residual vibration components and the noise components included in the residual vibration signal Vout can be differentiated from each other. As described below, phase index data NtF in accordance with the phase of the residual vibration and cycle index data NtC in accordance with the cycle of the residual vibration are generated based on the first comparison signal CP1, but generation of the phase index data NtF or the cycle index data NtC based on the residual vibration signal Vout is not possible in a case where the amplitude of the residual vibration is small and buried in noise. Moreover, the comparators 712 to 714 may have hysteresis properties.

Further, the first to fourth threshold potentials Vth1 to Vth4 have a relationship as follows.

$$Vth1 < Vth2 < Vth3 < Vth4$$

The amplitude of the residual vibration signal Vout becomes gradually larger, the amplitude thereof exceeds the second threshold potential Vth2 for the first time, and exceeds the third threshold potential Vth3, and then exceeds the fourth threshold potential Vth4. Accordingly, it is possible to obtain amplitude index data NtDadd in accordance with the amplitude of the residual vibration signal Vout based on the second comparison signal CP2 to the fourth comparison signal CP4.

The determination unit 80 illustrated in FIG. 20 includes a phase index data generation unit 81A that generates phase index data NtF in accordance with the phase of the residual vibration signal Vout based on the first comparison signal CP1; a cycle index data generation unit 81B that generates cycle index data NtC in accordance with the cycle of the residual vibration signal Vout based on the first comparison signal CP1; and an amplitude index data generation unit 82 that generates amplitude index data NtDadd in accordance with the amplitude of the residual vibration signal Vout.

The phase index data generation unit 81A includes a mask circuit 811, an edge detection circuit 812, and a timer 813. The cycle index data generation unit 81B includes the mask circuit 811, the edge detection circuit 812, and a timer 814. The mask circuit 811 and the edge detection circuit 812 are used for both of the phase index data generation unit 81A and the cycle index data generation unit 81B.

The mask circuit 811 outputs a first mask comparison signal MCP1 by masking the first comparison signal CP1 during a period for which a mask signal Msk1 is in a high level. The mask signal Msk1 is in a high level during a period Ta from a time t0 to a time ta as illustrated in FIG. 21. During the period Ta, the first mask comparison signal MCP1 is in a low level even when the first comparison signal CP1 changes.

In the above-described switching circuits U (U[1], U[2], . . . , U[M]), connection of the piezoelectric element 200 is switched between the driving signal generation unit 51 and the ejection abnormality detection unit 52, but noise is generated in synchronization with the switching. It is possible to remove the noise caused by the switching using the mask circuit 811. Further, mask circuits 821 to 823 described below function in the same manner.

The edge detection circuit 812 detects an edge of the first mask comparison signal MCP1 generated after the time ta passes and outputs a detection pulse Dp to the timer 813 and the timer 814 based on the mask signal Msk1 and the first mask comparison signal MCP1.

The timer 813 measures the time from when a signal Tsig, which is in a high level from the start of the residual vibration for a predetermined amount of time, rises to when the detection pulse Dp is being active and generates the phase index data NtF showing the measurement time. In the example of FIG. 21, the time from the time t0 to the time t1 is generated as phase index data NtF. This time is a time from when application of the driving signal for inspection to the piezoelectric element 200 is completed to when the residual vibration signal Vout passes by the first threshold potential Vth1 which is the amplitude center level and shows the phase of the residual vibration.

The comparator 711 has hysteresis properties as described above, and the first comparison signal CP1 maintains the low level and does not change in a case where the amplitude of the residual vibration is small and buried by the noise. In this case, since the detection pulse Dp is not generated, generation of the phase index data NtF based on the residual vibration signal Vout is not possible. In this case, the timer 813 generates a phase invalid flag frg1 showing that generation of the phase index data NtF is not possible.

Subsequently, the timer 814 measured a time from when the detection pulse Dp becomes active to when the next edge of the first mask comparison signal MCP1 is generated and generates the cycle index data Ntc showing the measurement time. In the example illustrated in FIG. 21, a time from the time t1 to the time t2 is generated as the cycle index data NtC. The time shows a time for one cycle of the residual vibration signal Vout.

Further, in a case where the detection pulse Dp maintains an inactive state or the first comparison signal CP1 maintains the low level and does not change, generation of the cycle index data NtC based on the residual vibration signal Vout is not possible. In this case, the timer 814 generates a cycle invalid flag frg2 showing that generation of the cycle index data NtC is not possible.

Next, the amplitude index generation unit 82 includes mask circuits 821 to 823, timers 824 to 826, and an adding circuit 827. The mask circuit 821 outputs a second mask comparison signal MCP2 by masking the second comparison signal CP2 during a period for which a mask signal Msk2 is in a high level. The mask signal Msk2 is in a high level during a period Tb from the time t0 to a time tb as illustrated in FIG. 21. During the period Tb, the second mask comparison signal MCP2 is in a low level even when the second comparison signal CP2 changes. In the same manner, a mask circuit 822 outputs a third mask comparison signal MCP3 by masking the third comparison signal CP3 during a period for which the mask signal Msk2 is in a high level. Further, a mask circuit 823 outputs a fourth mask comparison signal MCP4 by masking the fourth comparison signal CP4 during a period for which the mask signal Msk2 is in a high level.

The timer 824 measures a period for which the second mask comparison signal MCP2 is in a high level for the first time and outputs a measurement value NtD2 (first time) showing the measurement time, the timer 825 measures a period for which the third mask comparison signal MCP3 is in a high level for the first time and outputs a measurement value NtD3 (second time) showing the measurement time, and the timer 826 measures a period for which the third mask comparison signal MCP3 is in a high level for the first time and outputs a measurement value NtD4 showing the measurement time.

The adding circuit 827 generates the amplitude index data NtDadd by adding the measurement values NtD2 to NtD4. For example, when the waveform of the residual vibration signal Vout is a waveform V1 illustrated in FIG. 22, NtD2, NtD3, NtD4, and NtDadd respectively become Nt21, Nt31, 0, and Nt21+Nt31. Further, in a case where the waveform of the residual vibration signal Vout is a waveform V2, NtD2, NtD3, NtD4, and NtDadd respectively become Nt22, Nt32, Nt42, and Nt22+Nt32+Nt42. That is, the amplitude of the residual vibration signal Vout becomes larger as the amplitude index data NtDadd becomes larger.

Moreover, the amplitude of the residual vibration signal Vout is reflected in the measurement value NtD2, but it is possible to specify the amplitude of the residual vibration signal Vout more accurately by comparing the residual vibration signal Vout with a plurality of threshold values (Vth2 to Vth4) and calculating the total of these values.

Figure 23:
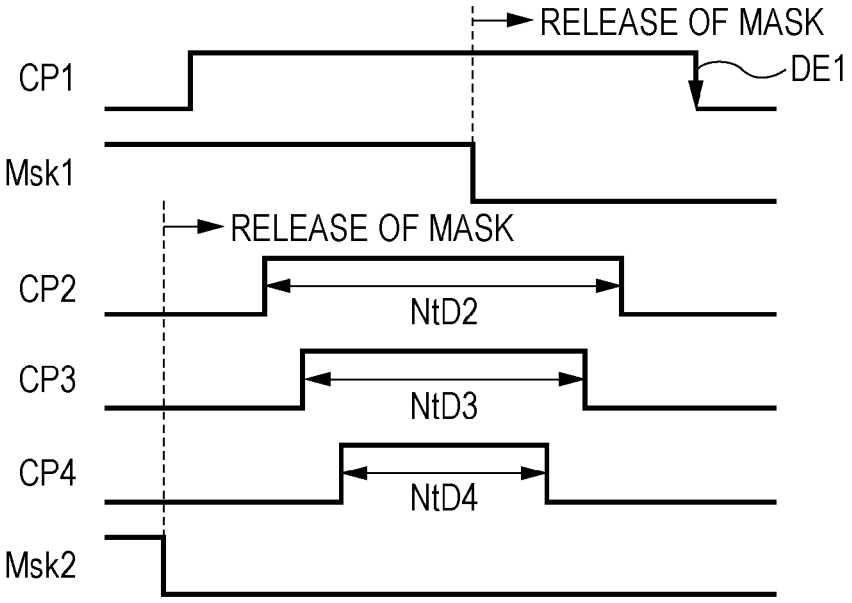
FIG. 23 is an explanatory diagram illustrating a relationship between mask signals and first to fourth comparison signals.
Figure 24:
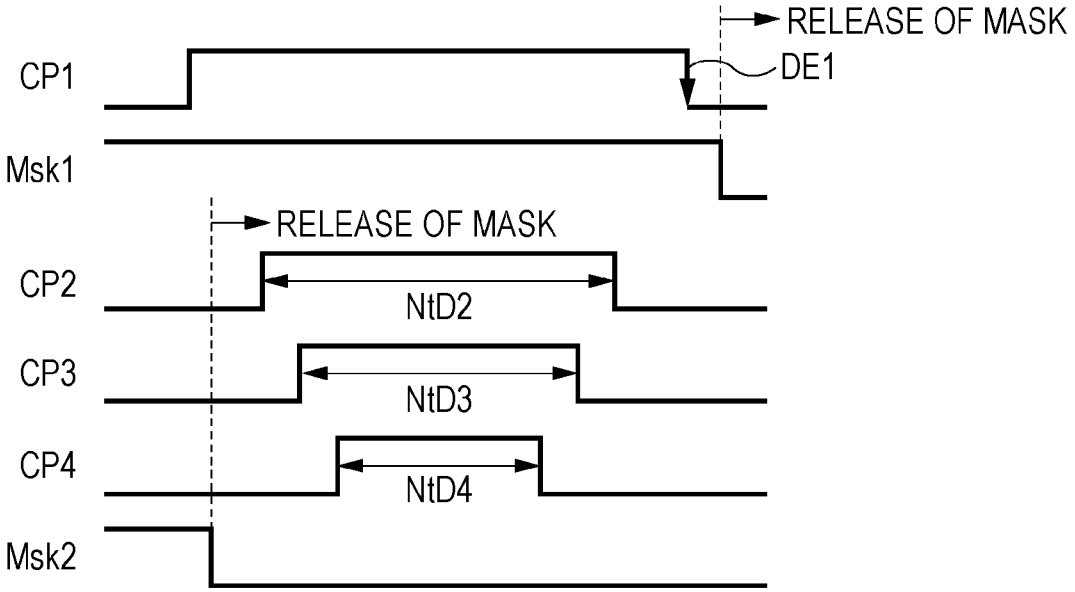
FIG. 24 is an explanatory diagram illustrating a relationship between mask signals and first to fourth comparison signals.
Figure 25:
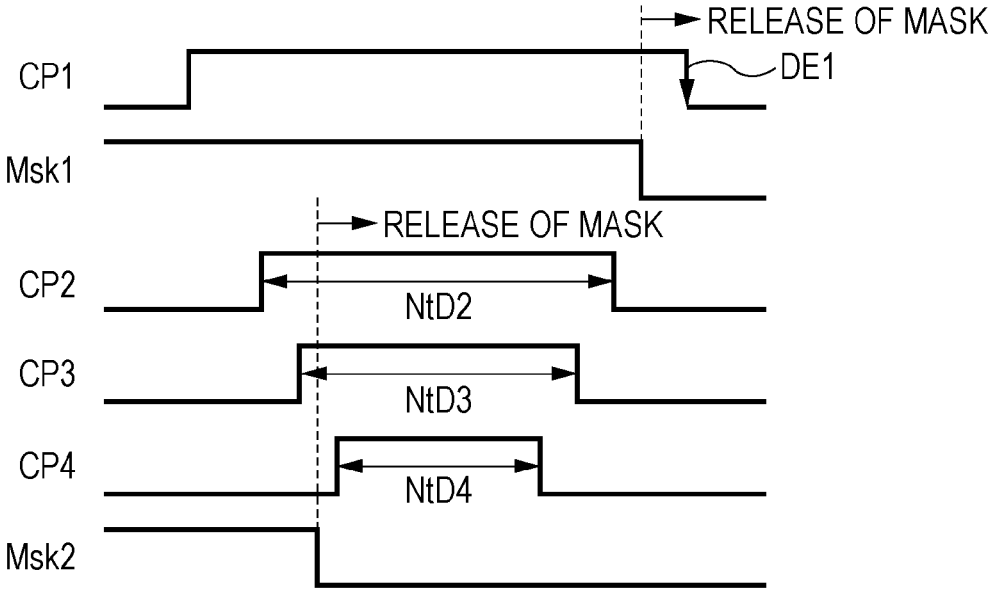
FIG. 25 is an explanatory diagram illustrating a relationship between mask signals and first to fourth comparison signals.

Next, a relationship between the mask signals Msk1 and Msk2 and the first to fourth comparison signals CP1 to CP4 with reference to FIGS. 23 to 25. After a falling edge of the mask signal Msk1 is generated and the mask is released as illustrated in FIG. 23, in a case where a falling edge DE1 of the first comparison signal CP1 is generated, the falling edge DE1 becomes valid. Further, after a falling edge of the mask signal Msk2 is generated and the mask is released, in a case where the second to fourth comparison signals CP2 to CP4 become active, the measurement values NtD2 to NtD4 become valid.

Meanwhile, in the example illustrated in FIG. 24, since the falling edge DE1 of the first comparison signal CP1 is generated before the mask is released by the mask signal Msk1, the phase index data NtF is not generated. Further, the measurement values NtD2 to NtD4 become valid.

Further, in the example illustrated in FIG. 25, since rising edges of the second comparison signal CP2 and the third comparison signal CP3 are generated before the mask is released by the mask signal Msk2, the measurement values NtD2 and NtD3 corresponding to these signals become zero, but the measurement value NtD4 becomes valid because a rising edge of the fourth comparison signal CP4 is generated after the mask is released.

Next, a determination data generation unit 83 illustrated in FIG. 20 determines the ejection state of the ink in the nozzles N based on the phase index data NtF, the phase invalid flag frg1, the cycle index data NtC, the cycle invalid flag frg2, and the amplitude index data NtDadd. The phase index data NtF becomes "Fmin≤NtF≤Fmax" in the case where the ejection state of the ink is normal. The determination data generation unit 83 compares the phase index data NtF with values of the lower limit Fmin and the upper limit Fmax. The determination data generation unit 83 generates 2 bits of phase evaluation data DF by combining the comparison results and the phase invalid flag frg1. FIG. 26 illustrates a truth table of the phase evaluation data. As illustrated in FIG. 26, the phase evaluation data DF becomes "00" in a case where the phase invalid flag frg1 becomes valid and generation of the phase index data NtF based on the residual vibration signal Vout is not possible, the phase evaluation data DF becomes "01" in a case where the phase index data NtF is lower than the lower limit Fmin, the phase evaluation data DF becomes "10" in a case where the phase index data NtF exceeds the upper limit Fmax, and the phase evaluation data DF becomes "11" in a case where the phase index data NtF is in the normal range.

The cycle index data NtC becomes "Cmin≤NtC≤Cmax" in the case where the ejection state of the ink is normal. The determination data generation unit 83 compares the cycle index data NtC with values of the lower limit Cmin and the upper limit Cmax. The determination data generation unit 83 generates 2 bits of cycle evaluation data DC by combining the comparison results and the cycle invalid flag frg2. FIG. 27 illustrates a truth table of the cycle evaluation data. As illustrated in FIG. 27, the cycle evaluation data DC becomes "00" in a case where the cycle invalid flag frg2 becomes valid and generation of the cycle index data NtC based on the residual vibration signal Vout is not possible, the cycle evaluation data DC becomes "01" in a case where the cycle index data NtC is lower than the lower limit Cmin, the cycle evaluation data DC becomes "10" in a case where the cycle index data NtC exceeds the upper limit Cmax, and the cycle evaluation data DC becomes "11" in a case where the cycle index data NtC is in the normal range.

In addition, the determination data generation unit 83 compares the amplitude index data NtDadd with a threshold value Tref and generates amplitude evaluation data DL. In a case where the amplitude index data NtDadd is greater than or equal to the threshold value Tref, the amplitude of the residual vibration signal Vout is in the normal range and the amplitude evaluation data DL becomes 1. Meanwhile, in a case where the amplitude index data NtDadd is smaller than the threshold value Tref, the amplitude of the residual vibration signal Vout is abnormal and the amplitude evaluation data DL becomes 0.

Further, the determination data generation unit 83 generates determination data Rs based on the phase evaluation data DF, the cycle evaluation data DC, and the amplitude evaluation data DL. The determination data Rs is 2 bits of data and indicates an error or oozing out in a case where the determination data Rs is "00," the determination data Rs indicates bubbles in a case where the determination data Rs is "01," the determination data Rs indicates thickening of the ink in a case where the determination data Rs is "10," and the determination data Rs indicates normal in a case where the determination data Rs is "11." More specifically, the residual vibration is hardly generated or the amplitude is small even when the residual vibration is generated in a case where the ink is thickened at the tip of the nozzle N or the nozzle N is blocked by foreign matters.

FIG. 28 illustrates a truth table of determination data. First, in the modes of NO1 to NO4, the amplitude of the residual vibration signal Vout is normal (DL=1), but the phase evaluation data DF shows that generation of the phase index data NtF based on the residual vibration signal Vout is not possible. It is considered that the circuit is faulty because of this mutual contradiction. Accordingly, the determination data Rs becomes "00" showing an error.

Further, in the modes of NO18 to NO20, the cycle index data NtC is generated although the phase evaluation data DF shows that generation of the phase index data NtF based on the residual vibration signal Vout is not possible. Since the cycle index data NtC is generated in the assumption that the phase index data NtF is valid, it is considered that the circuit is faulty because of this mutual contradiction. Accordingly, the determination data Rs becomes "00" showing an error.

Next, in the modes of NO5 to NO8, the amplitude index data NtDadd is in the normal range (DL=1) and the determination data generation unit 83 determines that bubbles are mixed into the cavity 245 (Rs="01") in the case where the phase index data NtF is lower than the lower limit Fmin of the normal range (DF="01"). This is because the phase of the residual vibration signal Vout advances because the inertance is decreased when bubbles are mixed into the cavity 245. At this time, the cycle index data NtC is not considered. This is because the phase index data NtF is more easily affected by the change of the inertance and has high sensitivity compared to the cycle index data NtC because the phase index data NtF is obtained prior to the cycle index data NtC as illustrated in FIG. 21 and is generated for a period of time longer than one cycle of the residual vibration signal Vout.

Further, in the modes NO21 to NO24, the amplitude index data NtDadd is lower than the lower limit Tref of the normal range (DL=0) and the determination data generation unit 83 determines that bubbles are mixed into the cavity 245 (Rs="01") in the case where the phase index data NtF is lower than the lower limit Fmin of the normal range (DF="01"). This is the case where the residual vibration signal Vout fluctuates without being buried in the noise in spite of the small amplitude of the residual vibration signal Vout and the phase advances. At this time, since it is considered that the inertance is decreased, the determination data generation unit 83 determines that bubbles are mixed into the cavity 245 (Rs="01") for the same reason as the case of the modes NO4 to NO8.

Next, in the mode of NO9, the amplitude index data NtDadd is in the normal range (DL=1), the phase index data NtF exceeds the upper limit Fmax of the normal range (DF="10"), the cycle invalid flag frg2 is valid, and generation of the cycle index data NtC based on the residual vibration signal Vout is not possible. In this case, the inertance is increased because the phase index data NtF exceeds the upper limit Fmax of the normal range and the determination data generation unit 83 determines that the ink is thickened (Rs="00") because generation of the cycle index data NtC based on the residual vibration signal Vout is not possible.

Next, in the mode of NO10, the amplitude index data NtDadd is in the normal range (DL=1), the phase index data NtF exceeds the upper limit Fmax of the normal range (DF="10"), and the cycle index data NtC is lower than the lower limit Cmin of the normal range (DC="01"). In this case, while the phase index data NtF suggests an increase of the inertance due to delay of the phase, the cycle index data NtC suggests a decrease of the inertance due to shortening of the cycle in the cycle index data NtC. The cycle index data NtC which is not easily affected by the past driving waveform signal is prioritized because the phase index data NtF may be affected by the preceding driving signal and the determination data generation unit 83 determines that bubbles are mixed into the cavity 245 (Rs="01").

Next, in the mode of NO11, the amplitude index data NtDadd is in the normal range (DL=1), the phase index data NtF exceeds the upper limit Fmax of the normal range (DF="10"), and the cycle index data NtC exceeds the upper limit Cmax of the normal range (DC="10"). In this case, the phase index data NtF and the cycle index data NtC suggest an increase of the inertance and thus the determination data generation unit 83 determines that the ink oozes out from the nozzle N (Rs="10").

Next, in the mode of NO12, the amplitude index data NtDadd is in the normal range (DL=1), the phase index data NtF exceeds the upper limit Fmax of the normal range (DF="10"), and the cycle index data NtC exceeds the upper limit Cmax of the normal range (DC="11"). In this case, the determination data generation unit 83 determines that the ink oozes out from the nozzle N (Rs="10") by focusing on the phase index data NtF.

Next, in the modes of NO13 and NO15, the amplitude index data NtDadd and the phase index data NtF are in the normal range (DL=1, DF="11"). Further, generation of the cycle index data NtC based on the residual vibration signal Vout is not possible or an increase of the inertance is suggested in a case where the cycle invalid flag frg2 is invalid (DC="00") or the cycle index data NtC exceed the upper limit Cmax of the normal range (DC="10"). Accordingly, the determination data generation unit 83 determines that the ink is thickened (Rs="00").

Next, in the mode of NO14, the amplitude index data NtDadd and the phase index data NtF are in the normal range (DL=1, DF="11"). Further, the cycle index data NtC is lower than the lower limit Cmin of the normal range (DC="01"). In this case, a decrease of the inertance is suggested due to shortening of the cycle in the cycle index data NtC and thus the determination data generation unit 83 determines that bubbles are mixed into the cavity 245 (Rs="01").

Next, in the mode of NO16, the amplitude index data NtDadd, the phase index data NtF, and the cycle index data NtC are in the normal range (DL=1, DF="11," DC="11"). In this case, the determination data generation unit 83 determines that the ejection state of the ink in the nozzle N is normal (Rs="11").

Next, in the mode of NO17, the amplitude index data NtDadd is lower than the lower limit Tref of the normal range, the phase invalid flag frg1 and the cycle invalid flag frg2 are zero, and generation of the phase index data NtF and the cycle index data NtC based on the residual vibration signal Vout is not possible. In this case, the determination data generation unit 83 determines that the ink is thickened (Rs="00").

In the modes of NO25 to NO28, the amplitude index data NtDadd is lower than the lower limit Tref of the normal range and the phase index data NtF exceeds the upper limit Fmax of the normal range. The presence of the residual vibration is recognized, but the amplitude thereof is relatively small. In addition, the phase of the residual vibration signal Vout is delayed. In this case, the inertance is significantly increased and thus the determination data generation unit 83 determines that the ink is thickened in a state in which the ink at the tip of the nozzle N is thickened or the nozzle N is blocked by foreign matters (Rs="00").

In the modes of NO29 to NO31, the amplitude index data NtDadd is lower than the lower limit Tref of the normal range and the phase index data NtF is in the normal range. Further, the cycle index data NtC is lower than the lower limit Cmim of the normal range or exceeds the upper limit Cmax thereof, or the cycle invalid flag frg2 is valid. In this case, the determination data generation unit 83 determines that bubbles are mixed into the cavity 245 (Rs="01").

In the mode of NO32, the amplitude index data NtDadd is lower than the lower limit Tref of the normal range and the phase index data NtF and the cycle index data NtC are in the normal range. In this case, the presence of the residual vibration is recognized, but the amplitude is small. The determination data generation unit 83 determines that the ink is thickened (Rs="00").

In this manner, the determination data Rs and the cycle index data NtC are transmitted to the control unit 6 illustrated in FIG. 1 from the ejection abnormality detection unit 52. The control unit 6 selects a recovery process in accordance with the determination data Rs and controls the recovery mechanism 84 such that the ink can be normally ejected from the nozzles N having ejection abnormality. Examples of the recovery process include a flushing process of ejecting the thickened ink from the nozzles N, a wiping process of wiping the surface of a nozzle plate, and an absorbing process of absorbing the ink from the nozzles N. The control unit 6 can select an appropriate recovery process according to the state of the ejection abnormality.

According to the above-described embodiment, information such as the phase or the cycle of the residual vibration in the time axis direction is generated and the information of the residual vibration in the amplitude direction can be generated by comparing a plurality of threshold potentials and the residual vibration signal Vout. As a result, it is possible to generate the amplitude index data NtDadd with a simple configuration.

Further, the amplitude index data NtDadd can be obtained by summing up a high-level period of the second comparison signal CP2 obtained by binarizing through comparison of the residual vibration signal Vout with the second threshold potential Vth2, a high-level period of the third comparison signal CP3 obtained by binarizing through comparison of the residual vibration signal Vout with the third threshold potential Vth3, and a high-level period of the fourth comparison signal CP4 obtained by binarizing through comparison of the residual vibration signal Vout with the fourth threshold potential Vth4. In this manner, it is possible to obtain more accurate information in the amplitude direction by comparing the residual vibration signal Vout with the plurality of threshold potentials and calculating the total of times of the comparison results.

MODIFIED EXAMPLES

The above-described modes can be modified in various ways. Specific aspects of modifications will be exemplified below. Two or more aspects arbitrarily selected from the examples below may be appropriately combined within a range without mutual contradiction.

Modified Example 1

In the above-described embodiments, the determination unit determines the oozing out of the ink for each nozzle N (NO11 and NO12 illustrated in FIG. 28). However, oozing out of the ink is generally generated in the plurality of nozzles N. Accordingly, the oozing out of the ink may be determined in a unit of a predetermined number of nozzles.

Figure 29:
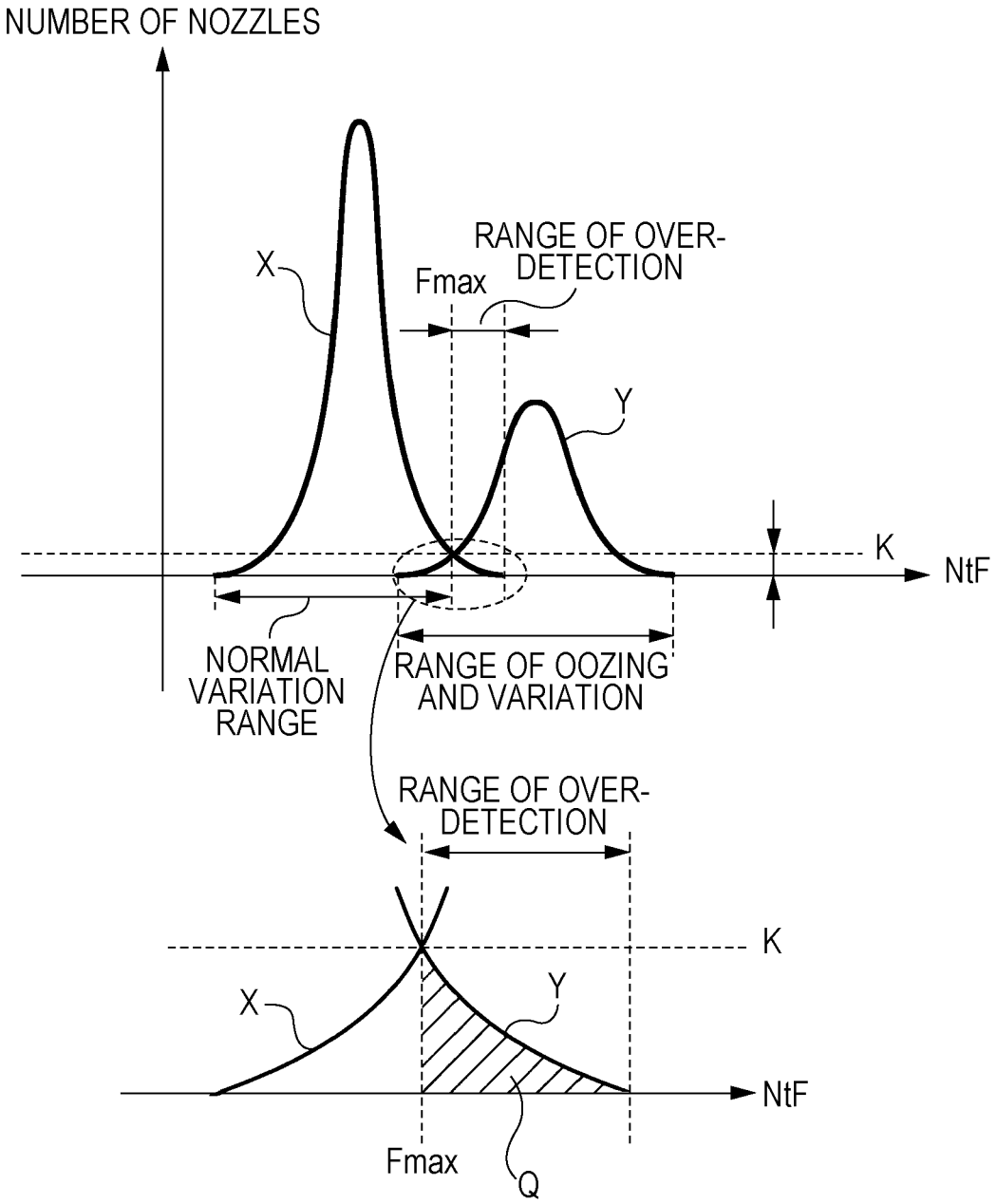
FIG. 29 is an explanatory diagram illustrating frequency distribution of phase index data of nozzles normally ejecting an ink and frequency distribution of phase index data of nozzles from which an ink oozes out.

FIG. 29 is an explanatory diagram illustrating frequency distribution X of the phase index data NtF of nozzles normally ejecting an ink and frequency distribution Y of the phase index data NtF of nozzles from which an ink oozes out. A part of the frequency distribution X of the nozzles normally ejecting the ink as illustrated in the figure is overlapped with a part of the frequency distribution Y of the nozzles from which the ink oozes out. Here, in a part Q in which the phase index data NtF exceeds the upper limit Fmax (threshold value) of the normal range, the determination unit determines that the ink oozes out although the ink is normally ejected. For this reason, in a case where the number of nozzles to be determined that the ink oozes out in a unit of a predetermined number of nozzles is k (reference value) or more, the determination unit may determine that the ink oozes out from the predetermined number of nozzles. In addition, in a case where the number of nozzles thereof is less than k, the determination unit may determine that the ink has not oozed out from the predetermined number of nozzles. In this case, it is possible to reduce the probability of over-detection of the oozing out of the ink and to determine in an appropriate way.

Modified Example 2

In the above-described embodiment, the ejection state of the ink (liquid) in the nozzles N is determined based on the first to fourth comparison signals CP1 to CP4, but the invention is not limited thereto. In addition, the ejection state of the ink in the nozzles N may be determined based on at least the first comparison signal CP1 and the second comparison signal CP2.

Modified Example 3

In the above-described embodiment, the phase index data NtF and the cycle index data NtC are generated based on the first comparison signal CP1, but only the phase index data NtF may be generated without limiting the invention thereto. In this case, the determination data generation unit 83 may determine the ejection state of the ink in the nozzles N based on the amplitude index data NtDadd and the phase index data NtF. Specifically, the amplitude index data NtDadd is in the normal range as illustrated in NO5 to NO8 of FIG. 28 and the phase index data NtF is lower than the lower limit Fmin of the normal range, it may be determined that bubbles are mixed into the cavity 245.

Modified Example 4

In the above-described embodiment and the modified examples, the driving waveform signals Com include three signals of Com-A, Com-B, and Com-C, but the invention is not limited thereto. The driving waveform signals Com may be formed of one signal (for example, only Com-A) or formed of arbitrary number of two or more signals (for example, Com-A and Com-B).

Moreover, in the above-described embodiment and modified examples, the control unit 6 supplies the driving waveform signals Com-A and Com-B (hereinafter, referred to as a "driving waveform signal for printing") for generating the driving signal Vin for printing and the driving waveform signal Com-C (hereinafter, referred to as a "driving waveform signal for inspection") for generating the driving signal Vin for inspection in each of the unit operation periods Tu, but the invention is not limited thereto. For example, the control unit 6 may change waveforms of each signal included in the driving waveform signals Com according to the types of processes performed in each of the unit operation periods Tu like supplying the driving waveform signals Com (for example, Com-A and Com-B) including only the driving waveform signal for printing in a case where the printing process is performed in a specific unit operation period Tu and supplying the driving waveform signals Com (for example, Com-C instead of Com-A) including only the driving waveform signal for inspection in a case where the ejection abnormality detecting process or the inspection waveform decision process is performed in a specific unit operation period Tu.

Further, the number of bits of the printing signal SI is not particularly limited to 3 bits and may be appropriately decided by gradation to be displayed and the number of signals included in the driving waveform signals Com.

Modified Example 5

In the above-described embodiments and the modified examples, a serial printer in which the main scanning direction of the head unit 30 and the sub scanning direction to which the recording paper P is transported are different from each other has been described as an example, but the invention is not limited thereto, and a line printer whose width of the head unit 30 becomes larger than or equal to the width of the recording paper P may be used. Since the determination of the ejection state due to the residual vibration can be performed without ejection of the ink to the recording paper P, it is possible to perform inspection of the ejection state during printing in the line printer.

Modified Example 6

In the above-described embodiment and the modified examples, the ejection state of the ink in the nozzles N is determined based on the phase index data NtF, the cycle index data NtC, and the amplitude index data NtDadd, but the ejection state of the ink in the nozzles N may be determined based on the ratio of the amplitude index data NtDadd to the cycle index data NtC (NtDadd/NtC). The cycle index data NtC varies for each nozzle N, but it is possible to evaluate the amplitude by absorbing the variation of the cycle because the amplitude of the residual vibration can be normalized by the cycle. As a result, it is possible to determine the ejection state of the ink in the nozzles N more accurately.

Furthermore, the ratio of the amplitude index data NtDadd to the cycle index data NtC is calculated for each nozzle N, the most frequent value of the nozzle array is specified based on the calculation results, and the threshold value Tref determining that the amplitude index data NtDadd is normal or abnormal may be determined based on the most frequent value.

The entire disclosure of Japanese Patent Application No. 2014-051212, filed Mar. 14, 2014 is expressly incorporated by reference herein.

What is claimed is:

1. A liquid ejection apparatus comprising:

a piezoelectric element that is displaced according to a driving signal;

a pressure chamber whose inside is filled with a liquid and in which a pressure inside is increased or decreased by the displacement of the piezoelectric element based on the driving signal;

a nozzle that communicates with the pressure chamber and is capable of ejecting the liquid filled in the inside of the pressure chamber through the increase or decrease of the pressure in the inside of the pressure chamber;

a driving signal supply unit that supplies the driving signal to the piezoelectric element;

a detection unit that detects a change of an electromotive force of the piezoelectric element as a residual vibration signal based on the change of the pressure in the inside of the pressure chamber, which is generated after the driving signal is supplied to the piezoelectric element;

a comparison signal generation unit that generates a first comparison signal obtained by binarizing the residual vibration signal with a first threshold value and a second comparison signal obtained by binarizing the residual vibration signal with a second threshold value; and a determination unit that determines an ejection state of the liquid in the nozzle based on at least the first comparison signal and the second comparison signal, wherein the first threshold value substantially coincides with an amplitude center level of the residual vibration signal, and wherein the determination unit includes a phase index data generation unit generating phase index data according to a phase of the residual vibration signal based on the first comparison signal and an amplitude index data generation unit generating amplitude index data according to the amplitude of the residual vibration signal based on at least the second comparison signal and determines an ejection state of a liquid in the nozzle based on the phase index data and the amplitude index data.

2. The liquid ejection apparatus according to claim 1, wherein the comparison signal generation unit generates a third comparison signal obtained by binarizing the residual vibration signal with a third threshold value, and the amplitude index data generation unit specifies a first time showing a time for which the residual vibration signal exceeds the second threshold value based on the second comparison signal and a second time showing a time for which the residual vibration detection signal exceeds the third threshold value based on the third comparison signal and generates the amplitude index data by summing up at least the first time and the second time.

3. The liquid ejection apparatus according to claim 1, wherein the determination unit includes a cycle index data generation unit generating cycle index data according to a cycle of the residual vibration signal based on the first comparison signal and determines an ejection state of a liquid in the nozzle based on the phase index data, the cycle index data, and the amplitude index data.

4. The liquid ejection apparatus according to claim 3, wherein the phase index data generation unit generates a time, as the phase index data, from application of the driving signal to the piezoelectric element to an edge of the first comparison signal generated after the first comparison signal is invalidated for a predetermined amount of time, and the cycle index data generation unit generates a time for one cycle, as the cycle index data, after the edge of the first comparison signal is generated.

5. The liquid ejection apparatus according to claim 4, wherein the determination unit determines that bubbles are mixed into the pressure chamber in a case where generation of the cycle index data based on the residual vibration signal is not possible, the cycle index data is lower than the lower limit of the normal range, or the cycle index data exceeds the upper limit of the normal range when the amplitude index data is lower than the lower limit of the normal range and the phase index data is in the normal range.

6. The liquid ejection apparatus according to claim 3, wherein the determination unit determines that the liquid is thickened in a case where the amplitude index data is in the normal range, the phase index data exceeds the upper limit of the normal range, and generation of the cycle index data based on the residual amplitude signal is not possible.

7. The liquid ejection apparatus according to claim 3, wherein the determination unit determines that bubbles are mixed into the pressure chamber in a case where the amplitude index data is in the normal range, the phase index data exceeds the upper limit of the normal range, and the cycle index data is lower than the lower limit of the normal range.

8. The liquid ejection apparatus according to claim 3, wherein the determination unit determines that the liquid oozes out from the nozzle in a case where the amplitude index data is in the normal range, the phase index data exceeds the upper limit of the normal range, and the cycle index data is greater than or equal to the lower limit of the normal range.

9. The liquid ejection apparatus according to claim 3, wherein the determination unit determines that the liquid is thickened in a case where generation of the cycle index data based on the residual vibration signal is not possible or the cycle index data exceeds the upper limit of the normal range when the amplitude index data is in the normal range and the phase index data is in the normal range.

10. The liquid ejection apparatus according to claim 3, wherein the determination unit determines that bubbles are mixed into the pressure chamber in a case where the amplitude index data is in the normal range, the phase index data is in the normal range, and the cycle index data is lower than the lower limit of the normal range.

11. The liquid ejection apparatus according to claim 3, wherein the determination unit determines that bubbles are mixed into the pressure chamber in a case where the amplitude index data is lower than the lower limit of the normal range and the phase index data is lower than the lower limit of the normal range.

12. The liquid ejection apparatus according to claim 3, wherein the determination unit determines that the liquid is thickened in a case where the amplitude index data is lower than the lower limit of the normal range and the phase index data exceeds the upper limit of the normal range.

13. The liquid ejection apparatus according to claim 3, wherein the determination unit determines that the liquid is thickened in a case where the amplitude index data is lower than the lower limit of the normal range, the phase index data is in the normal range, and the cycle index data is in the normal range.

14. The liquid ejection apparatus according to claim 1, wherein the determination unit determines that bubbles are mixed into the pressure chamber in a case where the amplitude index data is in a normal range and the phase index data is lower than the lower limit of the normal range.

15. The liquid ejection apparatus according to claim 1, wherein the first threshold value substantially coincides with the amplitude center level of the residual vibration signal, and the determination unit includes a cycle index data generation unit generating cycle index data according to a cycle of the residual vibration signal based on the first comparison signal and an amplitude index data generation unit generating amplitude index data according to the amplitude of the residual vibration signal based on at least the second comparison signal and determines an ejection state of a liquid in the nozzle based on a ratio of the amplitude index data to the cycle index data.

16. The liquid ejection apparatus according to claim 1, further comprising a predetermined number of the nozzles, wherein the determination unit determines whether index data generated based on at least the first comparison signal and the second comparison signal exceeds a threshold value, determines that a liquid oozes out from the predetermined number of nozzles in a case where the number of the nozzles determined in which the index data exceeds the threshold value is greater than or equal to a reference value, and determines that a liquid has not oozed out from the predetermined number of nozzles in a case where the number of nozzles determined in which the index data exceeds the threshold value is lower than the reference value.

* * * * *